US007343763B2

(12) United States Patent
Dolev

(10) Patent No.: US 7,343,763 B2
(45) Date of Patent: Mar. 18, 2008

(54) CYLINDER LOCK WITH MODIFIED CAM

(76) Inventor: Moshe Dolev, 17 Bareishit St., Ramat HaSharon (IL) 47201

( * ) Notice: Subject to any disclaimer, the term of this patent is extended or adjusted under 35 U.S.C. 154(b) by 0 days.

(21) Appl. No.: 11/423,959

(22) Filed: Jun. 14, 2006

(65) Prior Publication Data

US 2006/0283218 A1 Dec. 21, 2006

Related U.S. Application Data

(60) Provisional application No. 60/690,938, filed on Jun. 16, 2005.

(51) Int. Cl.
*E05B 17/04* (2006.01)
*E05B 9/10* (2006.01)

(52) U.S. Cl. ..... 70/379 R; 70/118; 70/380

(58) Field of Classification Search ..... 70/379 R, 70/379 A, 380, 118, 120, 103, 106; 292/38, 292/92, 141, 171
See application file for complete search history.

(56) References Cited

U.S. PATENT DOCUMENTS 2,637,196 A * 5/1953 Seaver et al. ..... 70/264
3,991,595 A * 11/1976 Bahry et al. ..... 70/120
5,577,409 A * 11/1996 Oyabu et al. ..... 70/379 R
6,834,520 B2 * 12/2004 LaConte et al. ..... 70/472
2004/0237611 A1 * 12/2004 Artsiely ..... 70/379 R

FOREIGN PATENT DOCUMENTS

DE 3626551 A1 * 2/1988 ..... 70/379 R
EP 72332 A1 * 2/1983 ..... 70/379 A
FR 2551126 A1 * 3/1985 ..... 70/118

* cited by examiner

*Primary Examiner*—Patricia Engle
*Assistant Examiner*—Alyson Merlino
(74) *Attorney, Agent, or Firm*—Edward Langer; Shiboleth, Yisraeli, Roberts, Zisman & Co.

(57) ABSTRACT

A cylinder lock having a body and a modified cam, the cylinder lock being adapted for moving an external element arranged to engage the modified cam, so that the external element slides axially on the cylinder lock body. In a preferred embodiment, the inventive cylinder lock is designed to utilize a helical cam which engages a movable sleeve, and this design is referred to as the HC cylinder lock. When operated by rotating the appropriate key within it, the movable sleeve can be moved in a linear fashion along the length of the HC cylinder lock thus converting rotational motion of the key to axial motion of the external element. This axial motion is used to position at least one locking bolt, of which the sleeve itself may be one, for the function of locking or unlocking a device. The streamlined design of the inventive HC cylinder lock enables efficient placement of a door lock within the hollow volume of a door.

23 Claims, 28 Drawing Sheets

SECTION A-A

CYLINDER LOCK WITH MODIFIED CAM

CROSS-REFERENCE TO RELATED APPLICATIONS

The present application claims priority of U.S. Prov. Patent Appln. Ser. No. 60/690,938 entitled "Cylinder Lock with Modified Cam", filed Jun. 16, 2005.

FIELD OF THE INVENTION

The present invention relates generally to cylinder-locks, and more particularly to cylinder locks with a sleeve slidably mounted so as to be arranged for motion along the length of the cylinder lock body, which engages a helical cam of the cylinder lock, thus converting rotational motion of the key to linear motion.

BACKGROUND OF THE INVENTION

The cylinder lock has been in use for more than 100 years as a standard apparatus for locking doors and other items such as containers. In common use nowadays is the European double cylinder lock apparatus 30, also known as the 'Haan' profile lock, shown in prior art FIG. 1.

The double cylinder lock apparatus 30 pictured in FIG. 1, comprises a key 32, a double cylinder lock 34, and a cam 36. The standard components mounted on the cylinder lock 30 can be seen in FIG. 2, including a rotatable cylinder plug 35 (FIG. 1) that is fastened in place by circlips 38, and rotatable cam 36 having mounted inside it a coupling assembly 40. Additional standard components such as pins and springs are not shown.

The double cylinder lock apparatus 30 is operated as follows: the key 32 is rotated inside said cylinder lock 34 and the cam 36 is consequently rotated. In a mortise-type lock construction, for example, this rotation causes a displacement of a bolt (not shown) in the tangential direction to the motion of the cam 36. The displacement of the bolt causes it, for example, to enter or exit a door jamb (not shown), that results in locking or unlocking of the door. In summary, the prior art uses a rotational motion which is converted to tangential motion in order to move said locking bolt(s).

However, this is just one type of cylinder lock given as an example of the prior art. There are a multitude of variations of shapes and sizes of cylinder locks in existence.

Another prior art example is shown in FIG. 3, in which a double cylinder lock fitted with a gear 44 is shown, as described in my previous work as a co-inventor, in U.S. Pat. No. 3,991,595, issued Nov. 16, 1976. The difference between FIG. 1, and FIG. 3, is that instead of a cam 36 being utilized as in FIG. 1, a gear 44 is mounted to the cylinder lock 34. The primary advantage of operating a cylinder lock 34 fitted with a gear 44 is the reduced rotational force needed to move larger or multiple locking bolts. Instead of using a single rotation of the key to provide the required force for moving the bolt(s), gear 44 can be arranged to drive a reduction gear, thus enabling the user to move the bolt(s) more easily, thus distributing the force needed to move the bolt(s) over a longer distance.

Additionally it can be seen in FIG. 4, that the only component that has been changed from FIG. 2, is the gear 44. The circlips 38 and the coupling assembly 40 remain the same in both prior art examples.

In my previous work as a co-inventor, as described in U.S. Pat. No. 4,154,070 issued May 15, 1979, a lock was disclosed that causes insertion of multiple bolts into the jamb surrounding the door in multiple directions. The disadvantage of this design is that in order to install the device, a large section of the door interior volume needs to be removed, which is a difficult, time consuming and expensive process. In addition, the door structure itself is substantially weakened, reducing overall security. The lock is made of thin sheet metal and is not strong enough.

Therefore, it would be desirable to provide an improved cylinder lock enabling design of more compact locks, with stronger materials, manufactured by advanced production technologies, at a reasonable price. The compact design will enable installation of the locks with minimal interference to the structural integrity of the door while at the same time utilizing components of the standard cylinder locks in use and in production around the world.

SUMMARY OF THE INVENTION

Accordingly, it is a principal object of the present invention to overcome the disadvantages associated with the prior art and provide a cylinder lock having a body and a modified cam, the cylinder lock being adapted for moving an external element arranged to engage the modified cam, so that the external element slides axially on the cylinder lock body.

The inventive cylinder lock enables compact design and low-cost production of various types of locks, with the entire cylinder lock being encased and fully protected from tampering or breakage by intrusion. The encased lock is designed for easy installation without weakening the door structure, and the lock utilizes as many standard components as possible to simplify and reduce the cost of the manufacturing process.

In accordance with a preferred embodiment of the present invention, there is provided a cylinder lock, having a body and a modified cam, said cylinder lock being adapted for moving an external element arranged to engage said modified cam, and slide axially on said cylinder lock body.

In a preferred embodiment, the inventive cylinder lock is designed to utilize a helical cam, and this design is hereinafter referred to as the HC cylinder lock. When the HC cylinder lock is operated by rotating the appropriate key within it, the movable sleeve can be moved in a linear fashion along the length of the HC cylinder lock thus converting rotational motion to axial motion. This axial motion is used to position at least one locking bolt, of which the sleeve itself may be one, for the function of locking or unlocking a device.

The movable sleeve has formed therein a threaded groove matching a helical threaded section formed on the helical cam, thereby enabling engagement of the sleeve and cam.

The inventive HC cylinder lock construction enables more efficient usage of the hollow volume of a door for placement of a door lock incorporating the HC cylinder lock, since its streamlined design makes it possible to place it within this space.

In an alternative embodiment, the modified cam comprises a protrusion extending radially from a rotatable portion of the cylinder lock, with the protrusion being adapted to engage a helical slot formed in the external element.

In another alternative embodiment, the external element comprises a winged section integrally formed therewith and projecting outwardly therefrom. The winged section is formed with a sloped surface which is arranged to move a locking bolt in a direction orthogonal to the cylinder body axis, in response to said axial sliding motion of the external element.

In this embodiment, the sloped surface comprises a diagonal slot formed in the winged section and extending between an end proximate the cylinder body and an end distal to the cylinder body. The proximate and distal ends of the diagonal slot are each formed with a non-sloped portion, with the proximate end non-sloped portion enabling a spring latch operation, and the distal end non-sloped portion enabling a deadlocking bolt operation.

The inventive cylinder lock can be utilized to provide several door locking mechanisms, including a security lock using a locking hasp and mounted on the external side of the door. The locking mechanism can be operated by the HC cylinder lock from either side of the door, with the locking mechanism encased and protected from all sides to prevent attempted intrusion. The locking bolts of the locking mechanism are operated by movement of a sleeve-type element which moves in the axial direction along the HC cylinder lock body.

The inventive HC cylinder lock can also be used with locking mechanisms utilizing multiple locking bolts, and in addition to the locking bolts a spring latch design can be provided, operated by the HC cylinder lock key or by the door handle.

In another alternative embodiment, the inventive HC cylinder lock may be incorporated in a padlock replacement, using a multi-bolt locking mechanism fixedly mounted external to a door. The multi-bolt locking mechanism operates using a sleeve which slides along the length of the HC cylinder lock, to move the multiple locking bolts. The multiple locking bolts of the locking mechanism engage a locking hasp mounted to the doorpost. The entire HC cylinder lock and locking mechanism is encased and fully protected from tampering or breakage by unauthorized intrusion.

Additional features and advantages of the present invention will become apparent from the following drawings and description.

BRIEF DESCRIPTION OF THE DRAWINGS

For a better understanding of the invention with regard to the embodiments thereof, reference is made to the accompanying drawings, not shown to scale, in which numerals designate corresponding elements or sections throughout, and in which.

DETAILED DESCRIPTION OF THE PREFERRED EMBODIMENTS

FIGS. 1-4 representing the prior art have been described above in the Background.

Figure 2:
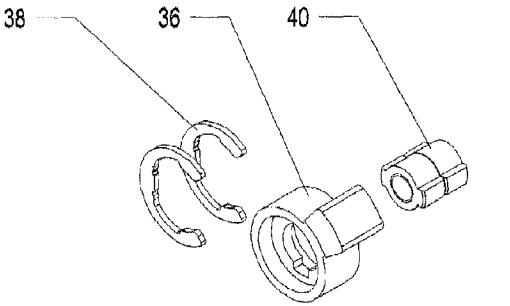
FIG. 2 PRIOR ART
FIG. 2 is an exploded view of some of the cylinder lock components shown in FIG. 1, featuring a cam, coupling and circlips.
Figure 4:
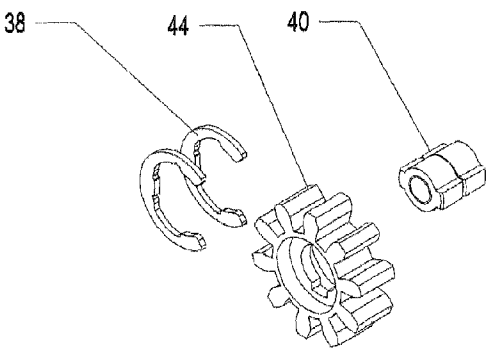
FIG. 4 PRIOR ART
FIG. 4 is an exploded view of several components of the cylinder lock shown in FIG. 3.
Figure 1:
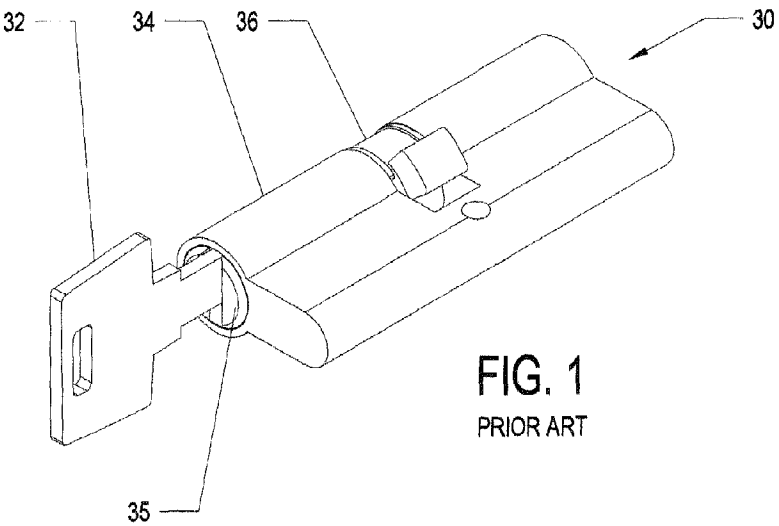
FIG. 1 PRIOR ART
FIG. 1 is a prior art illustration showing a European profile double cylinder lock with a single tooth cam.
Figure 3:
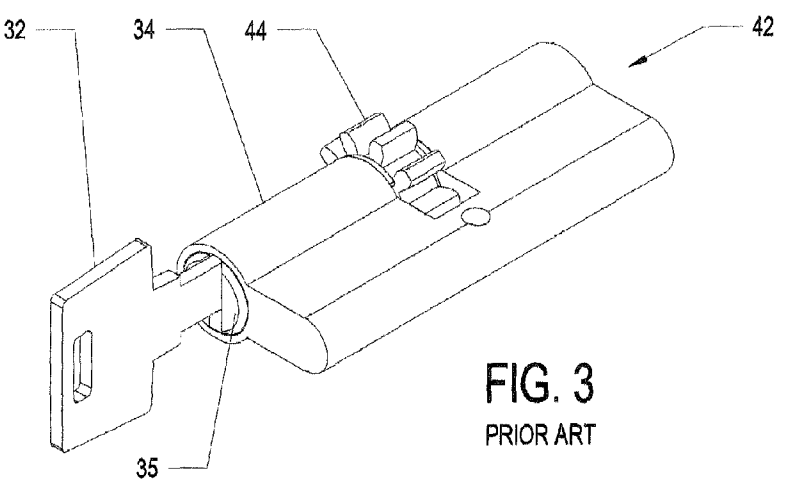
FIG. 3 PRIOR ART
FIG. 3 is a prior art illustration showing a European profile double cylinder lock with a gear.
Figures 5, 6:
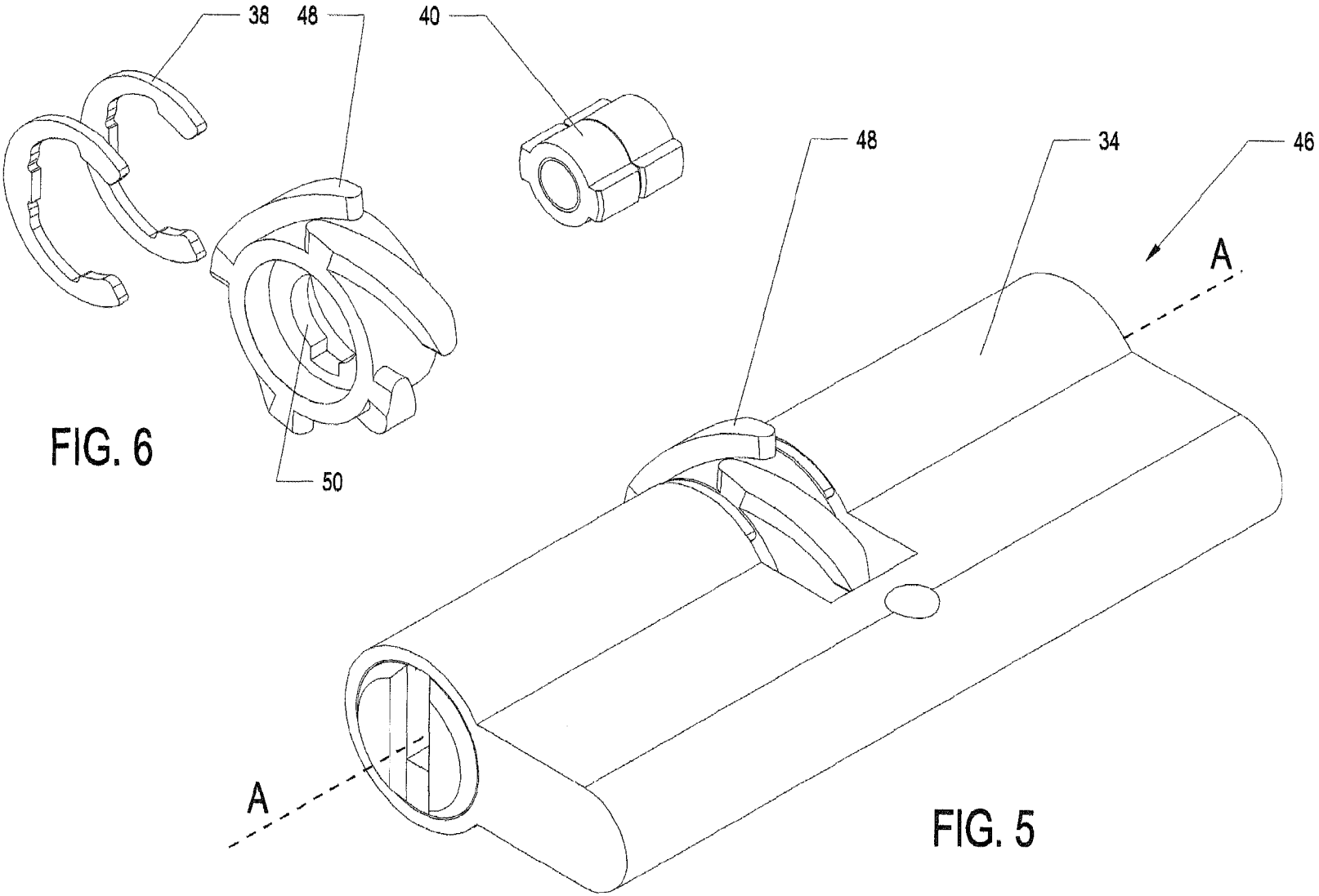
FIG. 5 is a perspective view of a preferred embodiment of a cylinder lock designed with a helical cam (HC) for enabling motion of a sleeve along the cylinder lock body, in accordance with the principles of the present invention.
FIG. 6 is an exploded view of several components of the HC cylinder lock shown in FIG. 5, featuring a helical cam, coupling and circlips.

Referring now to FIG. 5, there is shown a preferred embodiment of a cylinder lock having a modified cam and being arranged for slidable, axial motion of an external element (not shown) along the cylinder lock body length, constructed and operated in accordance with the principles of the present invention.

In the first example of a preferred embodiment of a double cylinder lock 34 arranged with a movable sleeve (see FIGS. 7-9), the traditional cam 36 or gear 44 is replaced by a helical cam 48. The cam is formed with at least one helical thread section, or more, as shown in following examples. The helical thread sections of the helical cam 48 can be designed for right or left-hand orientation with a variable pitch. FIG. 6 shows an example of a helical cam 48 which has four helical thread sections and a right-hand orientation. In this design, a full rotation of the key causes the movable sleeve to slide approximately 30 mm, along the cylinder lock body which has a typical length of 76 mm.

In FIG. 5 it can be seen how the helical cam 48 is mounted in a standard double cylinder lock 34, hereinafter referred to as a helical cam (HC) cylinder lock. It is important to note that the helical cam 48 is arranged to be mounted on the cylinder plug 35 in the same fashion with the circlips 38, and replaces the standard cam 36 or gear 44 that are currently used with common cylinder locks. Similarly the interior cavity 50 of the helical cam 48 matches that of the standard cam 36 and gear 44 and therefore can accommodate the insertion of the coupling assembly 40. The advantage of these design specifications is to ensure that only a minimum number of components need to be modified or replaced to incorporate the new technology into current lock manufacturing and production facilities.

As shown in FIG. 5, an axial line A-A is drawn through the center of the circular part of the cylinder lock 34, i.e. through the center of the section containing the keyway. Line A-A is also aligned with the center of the helical cam 48. From hereinafter, usage of the term "axial direction" is to be understood as the direction coincident with the axial line A-A.

FIG. 6 is an exploded view of several components of the HC cylinder lock 34 shown in FIG. 5, featuring a cam 48, coupling 40 and circlips 38.

Figures 7, 8, 9:
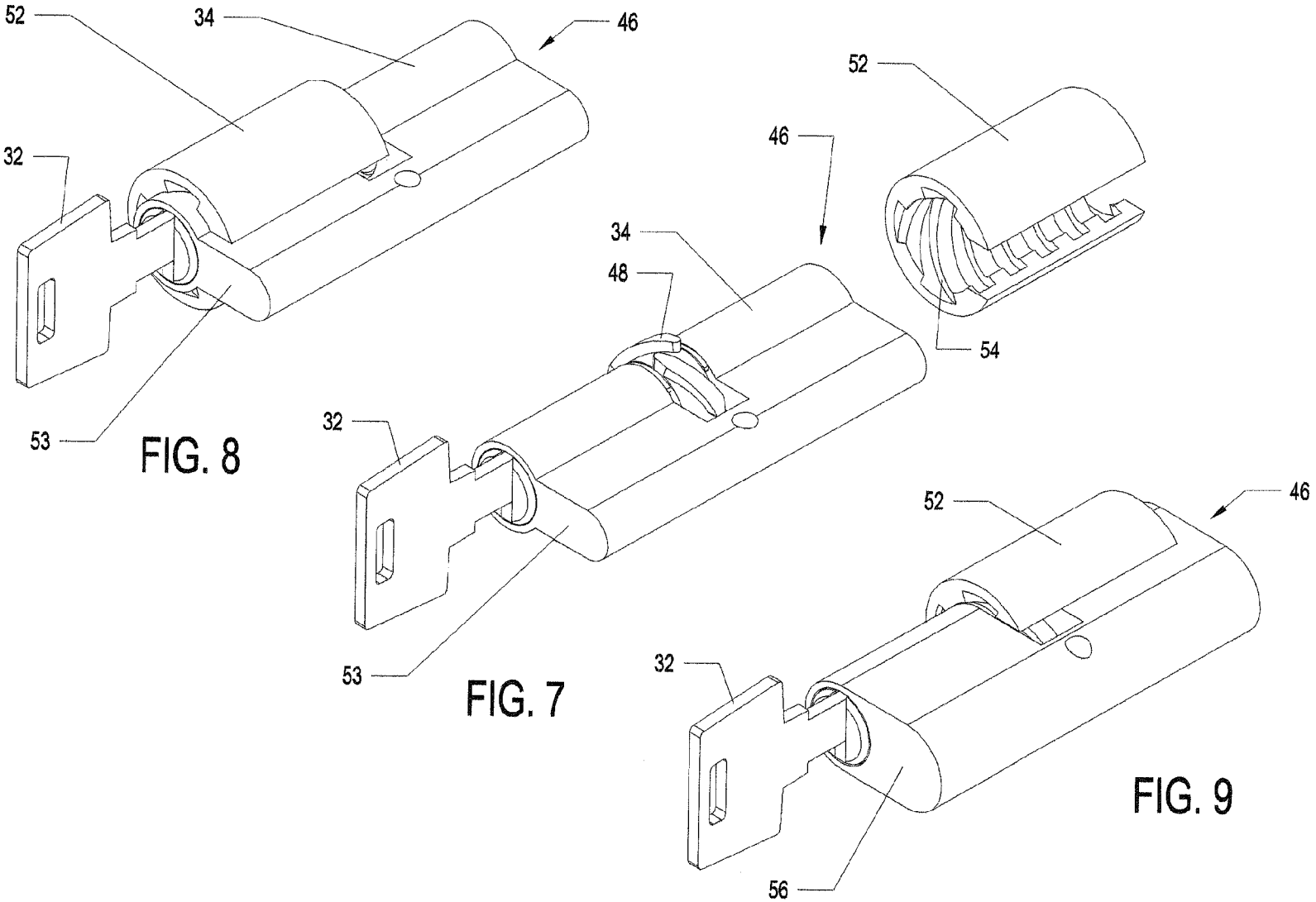
FIG. 7 is a perspective view of the inventive HC cylinder lock, showing a sleeve arranged for sliding motion on the cylinder lock body.
FIGS. 8-9 show, respectively, the position of the sleeve on front and rear ends of the HC cylinder lock body.

FIG. 7 is a perspective view of the inventive cylinder lock, showing a movable sleeve 52 arranged for sliding motion along the body of HC cylinder lock 34. The movable sleeve 52 has an inner thread 54 which is designed to match the threaded sections formed on helical cam 48.

This embodiment of the device, comprising a key 32, double cylinder lock 34, helical cam 48, movable sleeve 52 and all other cylinder lock internal components (not shown) shall hereinafter be called the movable sleeve-type HC cylinder lock 46.

In operation of the movable sleeve-type HC cylinder lock 46, the rotation of key 32 inside cylinder lock 34 causes helical cam 48 to rotate, and the threaded sections of helical cam 48 engage the matching inner thread 54 of movable sleeve 52. This engagement serves to translate the rotational motion of helical cam 48 into linear motion of movable sleeve 52 backwards or forwards in the axial direction, dependent on the direction of rotation of key 32. The inner diameter of cylindrical sleeve 54 is designed to fit properly around the body of HC cylinder lock 34 to guide its motion in the axial direction with minimal friction.

FIGS. 8-9 show, respectively, the position of the movable sleeve 52 on front and rear ends of the HC cylinder lock 34 body.

Referring now to FIG. 8, the movable sleeve 52 is positioned on the front half of the HC cylinder lock 34. When key 32 is rotated 360 degrees, movable sleeve 52 becomes displaced the length of the HC cylinder lock 34 as it is driven by the rotation of helical cam 48. The key 32 may then be removed after each full revolution.

Referring now to FIG. 9, the new position of cylindrical sleeve 52 is shown, for example, after a full revolution of key 32. The example shown moves cylindrical sleeve 52 from the front end of HC cylinder lock 34 to the rear end along the axial direction of HC cylinder lock 34.

It can be seen that the profile 53 of HC cylinder lock 34 in FIG. 8 is not the same as that of cylinder lock 56 in FIG. 9. This change was drawn to demonstrate that the concept being discussed can be applied to alternative profiles of cylinder locks. Additionally, there is no concern that there will be excessive displacement of sleeve 52, causing it to disengage from the HC cylinder lock 34, as movement of sleeve 52 will be guided by a housing (not shown) as well.

Figures 10, 11, 12:
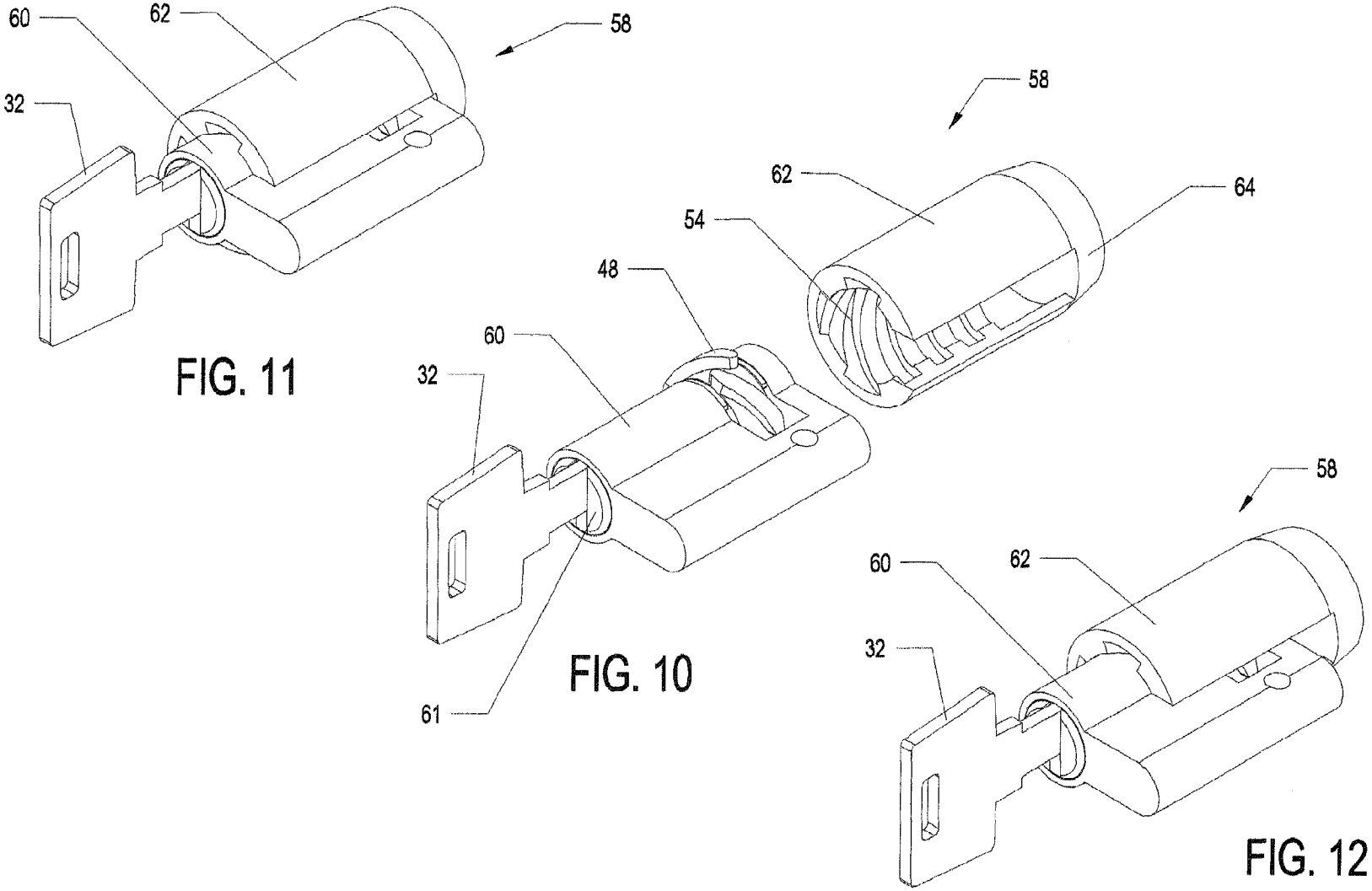
FIG. 10 is a perspective view of another embodiment of the inventive HC cylinder lock, showing a reinforced-end sleeve arranged for sliding motion on a single cylinder lock body.
FIGS. 11-12 show the sleeve in alternative positions on the HC single cylinder lock body.

In FIGS. 10-12, there is shown a single cylinder lock 60. Mounted on single cylinder lock 60 is a variation of the sleeve shown with movable sleeve-type HC cylinder lock 46. When compared with movable sleeve 52 which was shown earlier, it can be seen that this sleeve 62 has a reinforced end 64, which is adapted to serve as a locking bolt. The reinforced-end sleeve 62 has the same helical thread 54 and diameter as movable sleeve 52.

This embodiment of the device, comprising a key 32, a single cylinder lock 60, rotatable cylinder plug 61, helical cam 48, reinforced-end sleeve 62 and common cylinder lock internal components (not shown) shall hereinafter be called the reinforced-end sleeve-type HC cylinder lock 58.

The advantage of reinforced-end sleeve-type HC cylinder lock 58 is that it can be used itself as the locking bolt which will secure devices as will be explained below.

Referring now to FIG. 11, reinforced-end sleeve-type HC cylinder lock 58 is shown in its retracted mode, i.e. reinforced-end sleeve 62 is in the closest position to the key 32.

In FIG. 12 the key has been rotated a full turn and the reinforced-end sleeve 62 has moved in the axial direction, increasing the distance of the reinforced-end sleeve 62 from the key 32, into the extended position. This extended mode can be used to lock devices as will be explained below.

In the current example, the reinforced-end sleeve-type HC cylinder lock 58 may not require a full revolution of the key 32 to provide the movement desired. If the key 32 is turned about a quarter revolution, or about ninety degrees, this will result in a 7.5 mm movement by the reinforced-end sleeve 62, which in the present embodiment will be sufficient to lock a device.

Figures 13, 14, 15:
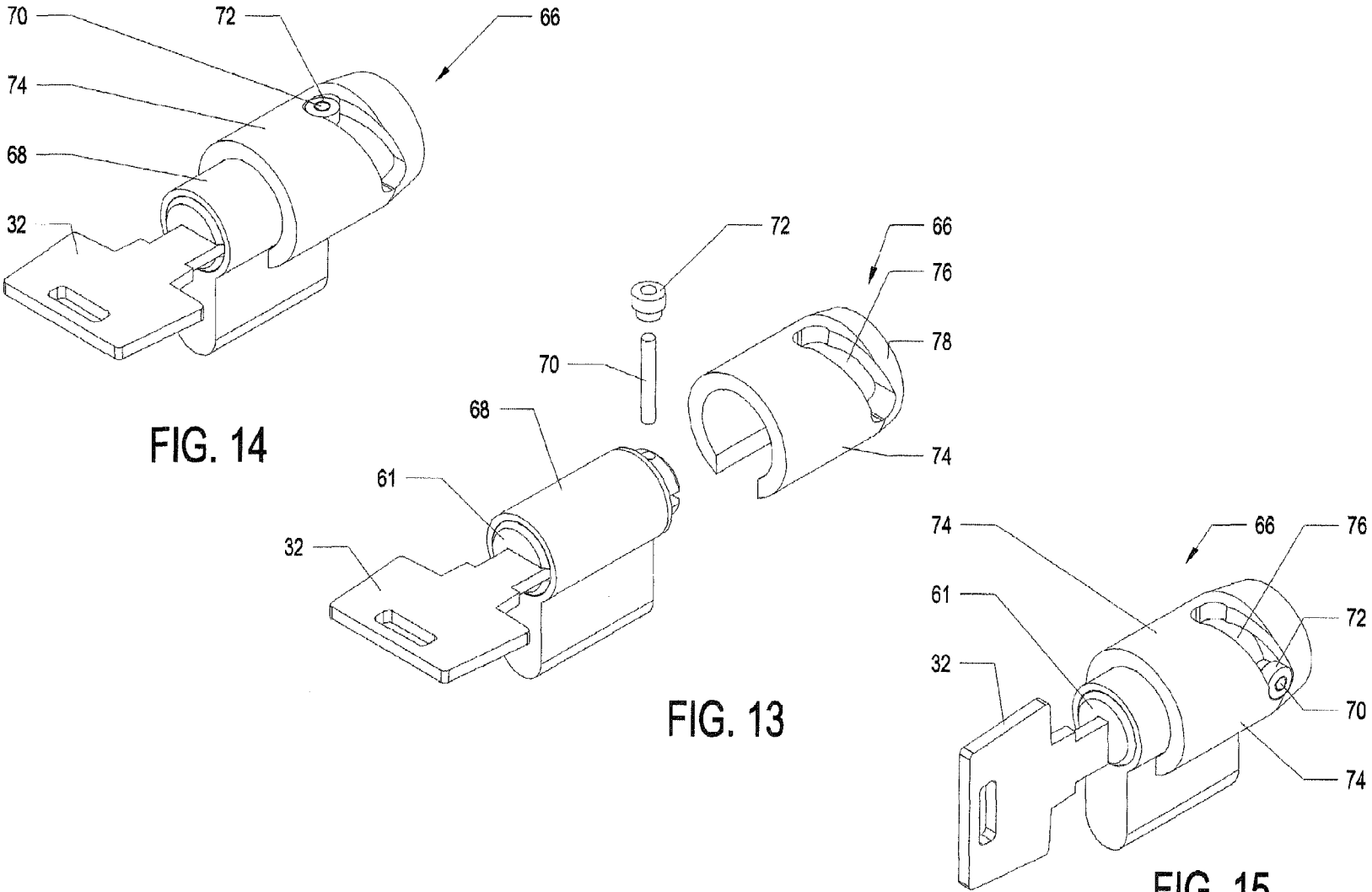
FIGS. 13-15 show an alternative sleeve design, featuring a single helical slot construction, arranged for sliding motion on a single cylinder lock body.

FIGS. 13-15 show an alternative construction of a movable sleeve that operates on a similar rotation-to-axial motion principle as in the previous embodiment.

This embodiment of the device, comprising a key 32, a single cylinder lock 68, pin 70, roller 72, helical slotted-reinforced-end sleeve 74 and internal components (not shown) shall hereinafter be called the helical slot, reinforced-end sleeve-type cylinder lock 66.

The reinforced-end sleeve 74 has a helical slot 76 that runs spirally along a portion of the length of the sleeve. The angle of the spiral slot facilitates axial motion of the sleeve as will be explained below. The helical slot, reinforced-end sleeve 74 is mounted on a single cylinder lock 68, which has a pin 70 inserted in the cylinder plug 35 and arranged for rotation together with it. In the present embodiment, the pin has a roller 72 mounted on it. The roller 72 is inserted in the spiral slot 76 of the helical slot, reinforced-end sleeve 74 and serves to reduce friction during the motion of the pin 70 along the length of the helical slot 76. The roller 72 is not an essential feature of the design.

Figure 16:
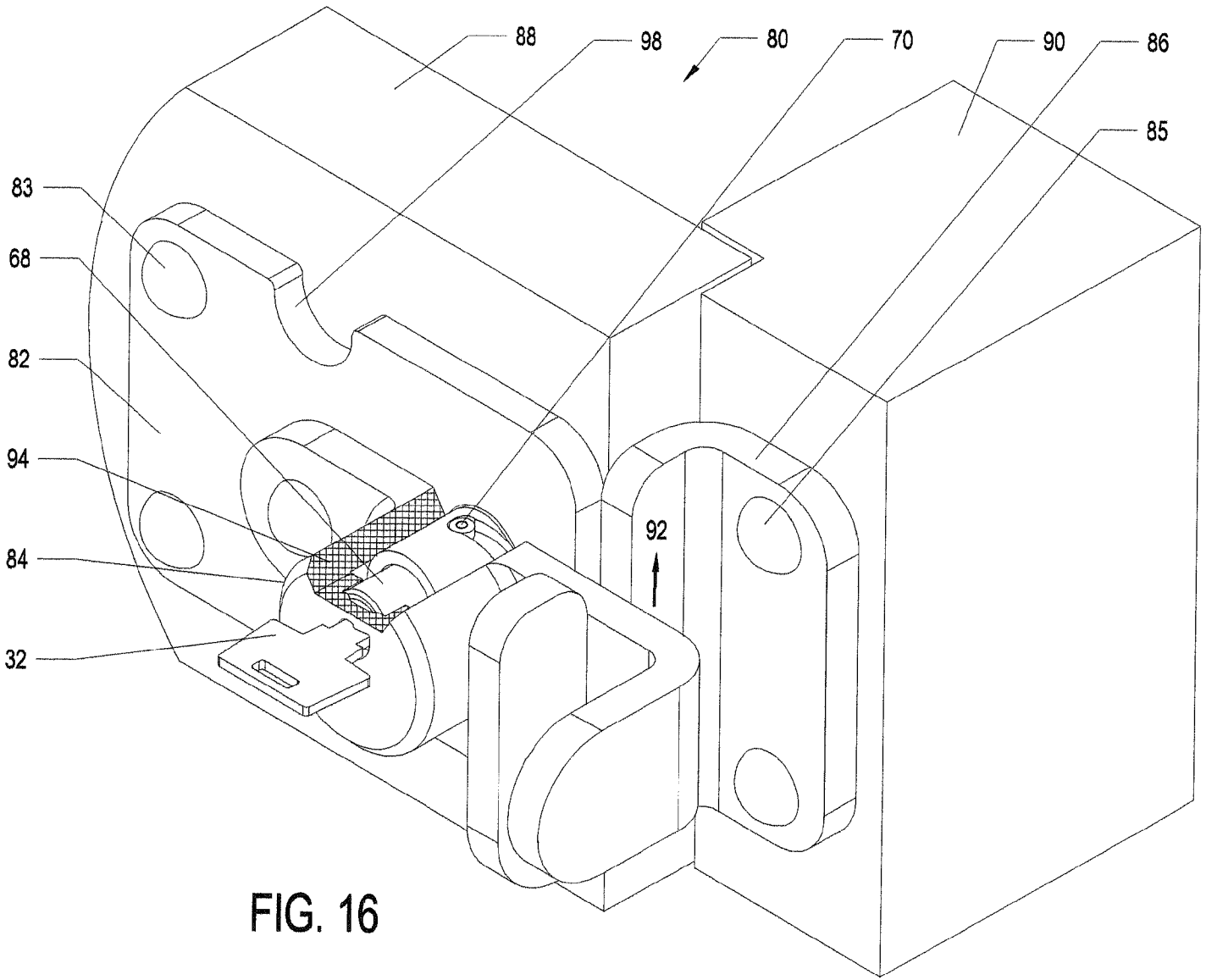
FIGS. 16-17 show examples of an application of a single cylinder lock with the helical slot sleeve construction of FIGS. 13-15.

In operation, the helical slot, reinforced-end sleeve-type cylinder lock 66 may be initially positioned in the locked or extended position shown in FIG. 14. When the key 32 is rotated about a quarter revolution inside the single cylinder lock 68, it cannot be removed. The pin 70 rotates with the cylinder plug 61 by the same amount. It is important to note the pin 70 does not move in the axial direction with respect to the cylinder lock 68. As the pin 70 rotates within helical slot 76 (as seen in FIG. 16), the helical slot, reinforced-end sleeve 74 is moved in the axial direction. The retracted position of the helical slot, reinforced-end sleeve 74 with respect to the cylinder lock 68 is shown in FIG. 15. In this embodiment the ends of the slot 76 restrict the motion of the pin 70 and therefore the rotation of the key 32 to about a quarter revolution.

In application, the extended position of the helical slot, reinforced-end sleeve-type cylinder lock 66 can be used to lock a device, as the reinforced end 78 of the sleeve 74 can be utilized as a bolt as will be elaborated below.

Figure 17:
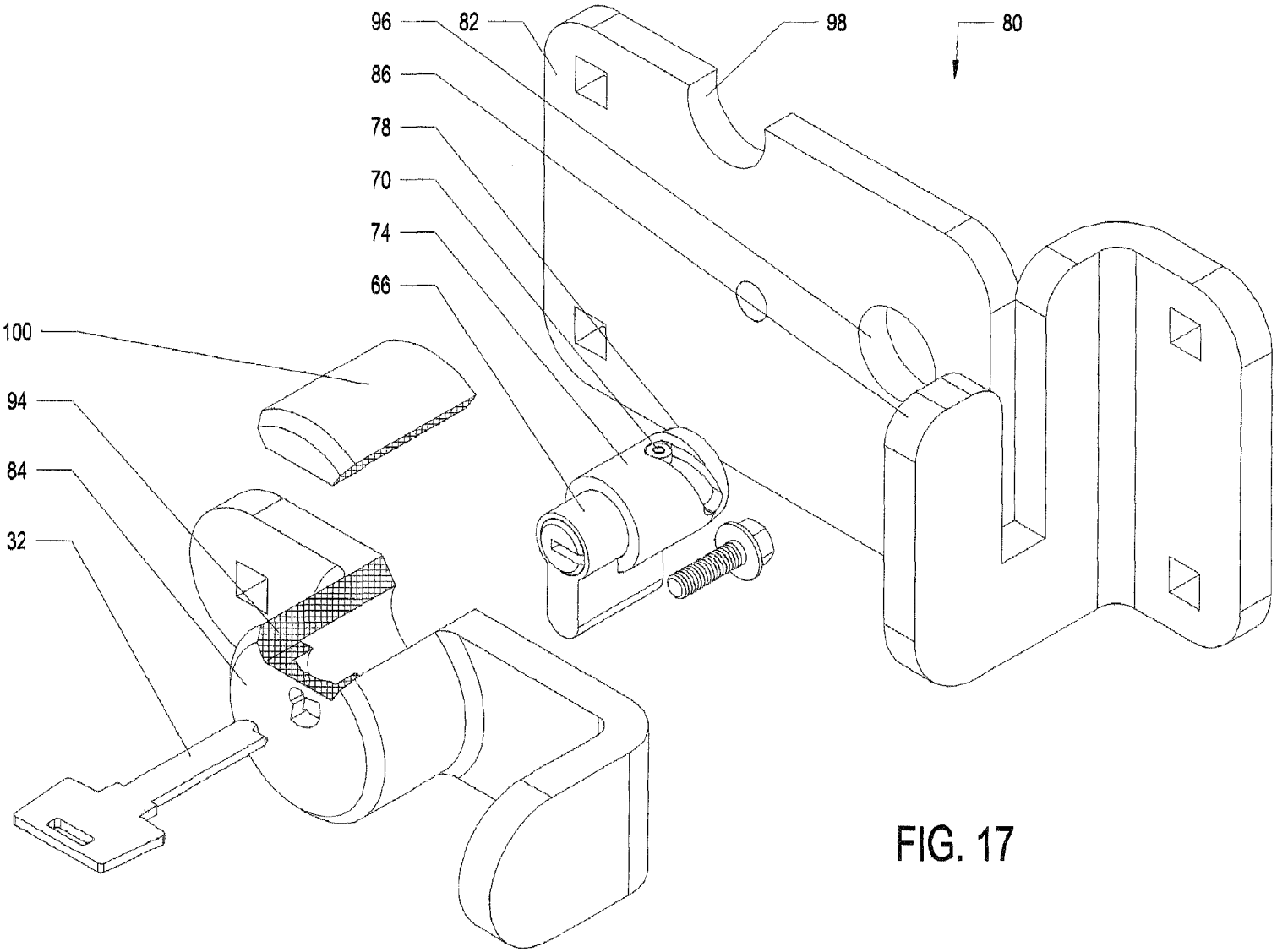

FIGS. 16-17 show examples of an application of the helical slot, reinforced-end sleeve-type cylinder lock 66.

In FIG. 16, there is shown a pivotal bar lock 80 within which there is encased a helical slot, reinforced-end sleeve-type cylinder lock 66. The helical slot, reinforced-end sleeve-type cylinder lock 66 is mounted inside a pivotal bar 84. The pivotal bar 84, which in this embodiment of the device can rotate about 90 degrees in the direction of the arrow 92, is mounted on a locking hasp 82. The locking hasp 82 is secured to a door 88 by carriage bolts 83, while the anchor locking hasp 86 is secured to a door post/door frame 90 by carriage bolts 85. The sectioned area 94 is drawn only to facilitate understanding of the positioning of the helical slot, reinforced-end sleeve-type cylinder lock 66 within the pivotal bar 84.

In FIG. 17, the removed section 100 of the pivotal bar 84 is shown. The pivotal bar 84 can be rotated to interlock with anchor hasp 86 secured to door post 90.

In operation, when key 32 is rotated inside the helical slot, reinforced-end sleeve-type cylinder lock 66, the reinforced-end sleeve 74 moves in the direction away from key 32, causing the reinforced end 78 to be inserted into a circular cavity 96 in the locking hasp 82. Thus the helical slot, reinforced-end sleeve 74 effectively becomes a bolt. This insertion of the helical slot, reinforced-end sleeve 74 inside the locking hasp 82 prevents the pivotal bar 84 from being rotated and unlocking the device.

Similarly, the pivotal bar lock 80 can be locked in its 'open' position, by rotating the pivotal bar 90 degrees vertically in the direction of the arrow 92 from its interlocked position with the anchor hasp 86 and inserting the helical slot, reinforced-end sleeve 74 inside groove 98 by rotating the key 32. The open and secured position prevents the device being locked by someone other than the possessor of the key.

As will be appreciated by those skilled in the art, the reinforced-end sleeve-type HC cylinder lock 58 of FIGS. 10-12 can be substituted in the application shown in FIGS. 16-17.

Figure 18:
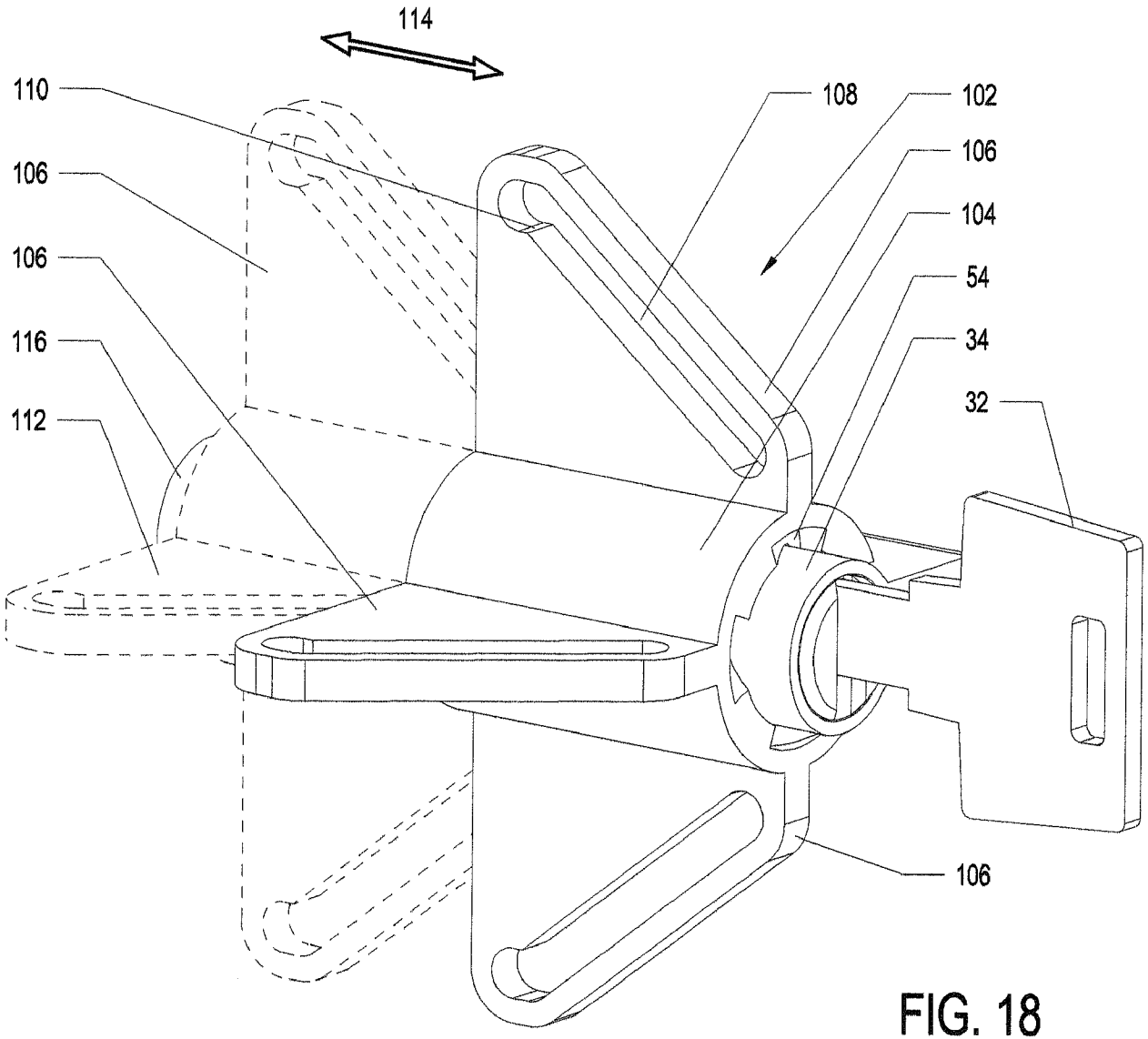
FIG. 18 shows a perspective view of another alternative embodiment of the inventive HC cylinder lock, featuring a slidable sleeve having wings each formed with a diagonal slot, for operating a locking bolt.

Shown in FIG. 18, is a further example of a movable sleeve HC cylinder lock variation.

This embodiment of the device, comprising a key 32, a double HC cylinder lock 34, a helical cam 48 (not shown), a winged-sleeve 104 and other common cylinder lock internal components (not shown) shall hereinafter be called a multi-bolt lock, equipped with a winged-sleeve HC cylinder lock 102.

The winged-sleeve 104 has an internal helical thread 54 similar to the internal helical thread 54 of the movable sleeve 52 that allows it to be moved by the same helical cam 48 as in previous embodiments. In contrast to the cylindrical shape of movable sleeve 52, the winged-sleeve 104 has, in this embodiment, three identical slotted wings 106. In other embodiments the wings may not be identical and may vary amongst other things in the number of wings and the angle of inclination of the slots in the wings. The slotted wings 106 contain diagonal slots 108 that have formed, at a distal end, a non-sloped portion 110, i.e. a slot substantially parallel to the axial direction. The distal end non-sloped portion 110 enables a deadlocking bolt operation.

In operation, the key 32 is rotated and the resultant rotational motion of the helical cam 48 (not shown) causes the winged-sleeve 104 to move in the axial direction in an identical fashion to the movable sleeve-type HC cylinder lock 46. The dotted outline 112 of the winged movable sleeve 104 shows the repositioned winged-sleeve 104 after it has moved in the axial direction, as shown by arrow 114, due to rotation of the key 32. It can be seen by the edge 116 of the HC cylinder lock 34 that the repositioned winged-sleeve 104, as shown by the dotted outline 112, is still mounted on the HC cylinder lock 34.

Figure 19:
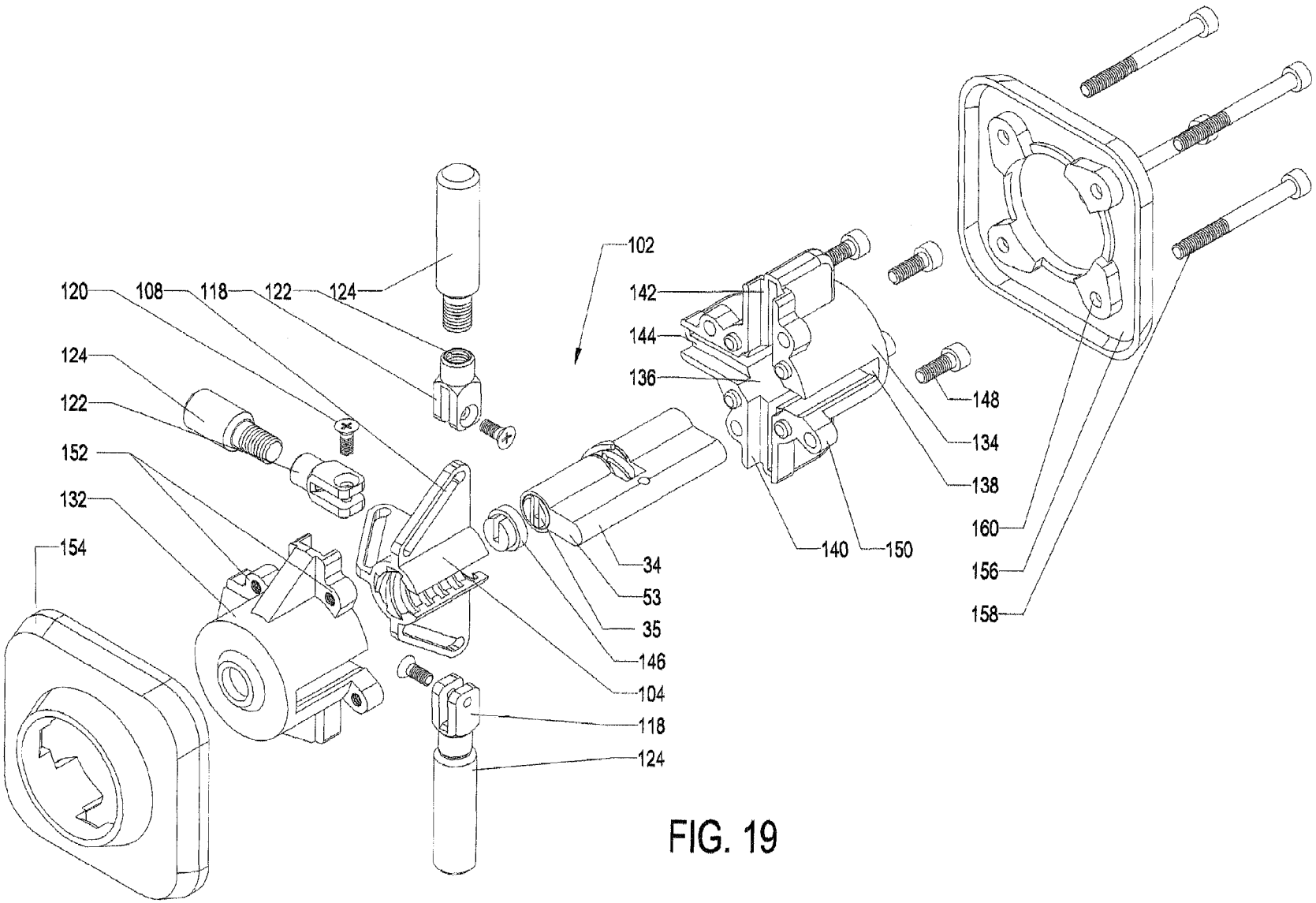
FIG. 19 is an exploded perspective view of a high security multi-bolt lock, equipped with a sleeve-type HC cylinder lock, for use in a locking application.

FIG. 19 is an exploded perspective view of a high security multi-bolt lock, equipped with winged-sleeve HC cylinder lock 102, for use in a locking application.

Referring to FIG. 19, on the HC cylinder lock 34 there is mounted a winged-sleeve 104. Shown positioned above the non-sloped portion 110 of one of the slotted wings 106 is a bolt holder 118. The bolt holder 118 is fastened to the winged-sleeve 104 by a slot follower-type screw 120 which is screwed into the threaded lower section of the bolt holder 118 and is also slidably mounted in the slot 108 of the winged-sleeve 104. The bolt holder 118 has a threaded cavity 122 to facilitate the secure insertion of a bolt 124. An example of the assembled bolt 124 and bolt holder 118 is shown. The bolts 124 may be of desired length.

The high security multi-bolt lock, equipped with winged-sleeve HC cylinder lock 102 is contained within an external housing 132 and an internal housing 134. The HC cylinder lock 34 is seated in cavity 136 in the internal housing 134 and matching cavity in the external housing 132 (not visible). The profile 53 of the HC cylinder lock 34 is seated in cavity 138 in the internal housing 134 and matching cavity in the external housing 132 (not visible).

The wings 106 of the winged-sleeve 104 are seated in cavities 140, 142 and 144 in the internal housing 134 and matching cavities in the external housing 132 (not visible).

The external end of the cylinder plug 35 on the HC cylinder lock 34 is protected by a rotatable protection disc 146 to prevent drilling.

The external housing 132 and internal housing 134 are fastened together by a plurality of screws 148 that join the flange 150 on the internal housing 134 and the flange 152 on the external housing 132.

An external escutcheon plate 154 is fitted on the external housing 132 and secured through the door to the internal escutcheon plate 156 by screws 158, via holes 160.

The external components such as the external escutcheon plate 154 and the rotating disc 146 are to be made of hard material to prevent drilling or tampering.

Figure 20:
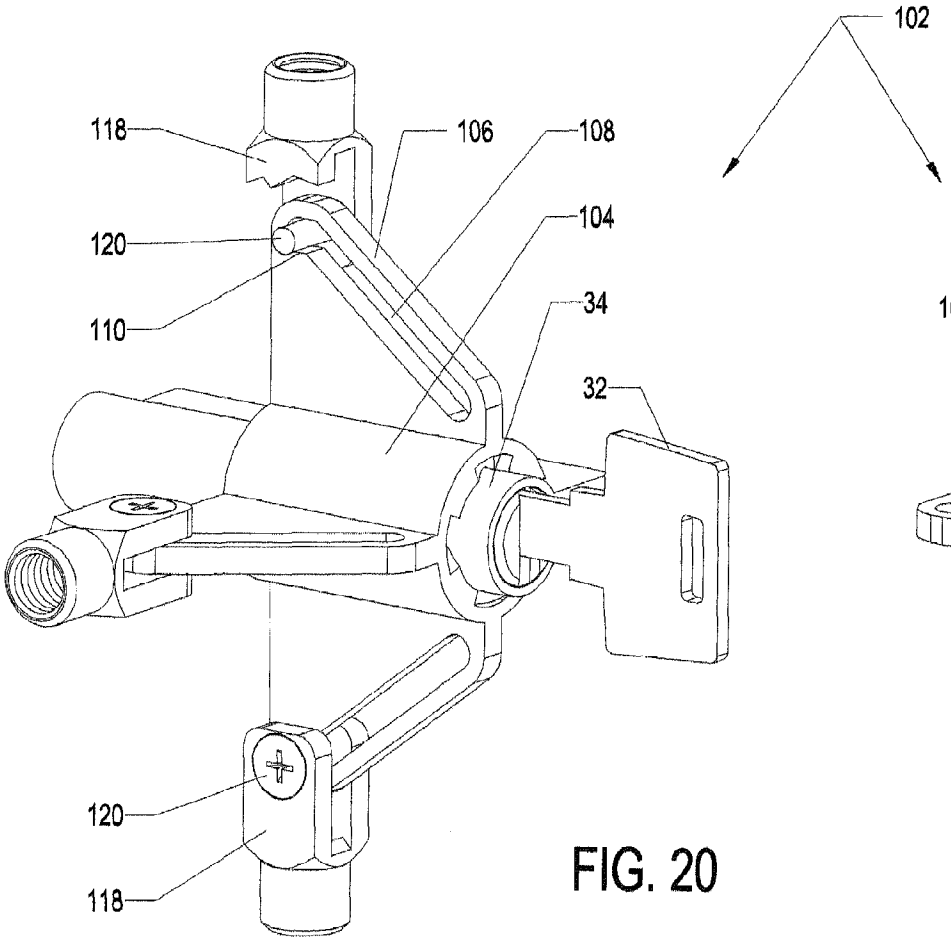

In FIG. 20, there is shown a better view of the bolt holder 118 shown attached in sliding fashion to the winged-sleeve 104 by the screw 120. The bolt holder 118 and the screw 120 respectively, have had a section removed to better view their mounting on winged-sleeve 104.

As shown in FIG. 20, screw 120 of each bolt holder is positioned in the non-sloped portion 110. The purpose of the non-sloped portion 110 of the slotted-wings 106 is to develop a separate deadlocking bolt operation for each bolt 124.

As shown in FIG. 20, with the bolt holders 118 positioned in the non-sloped portion 110, the bolts 124 (not shown) would be fully extended and inserted into, for example, the cavities in the jamb of a door, thereby locking the door in place.

Figure 21:
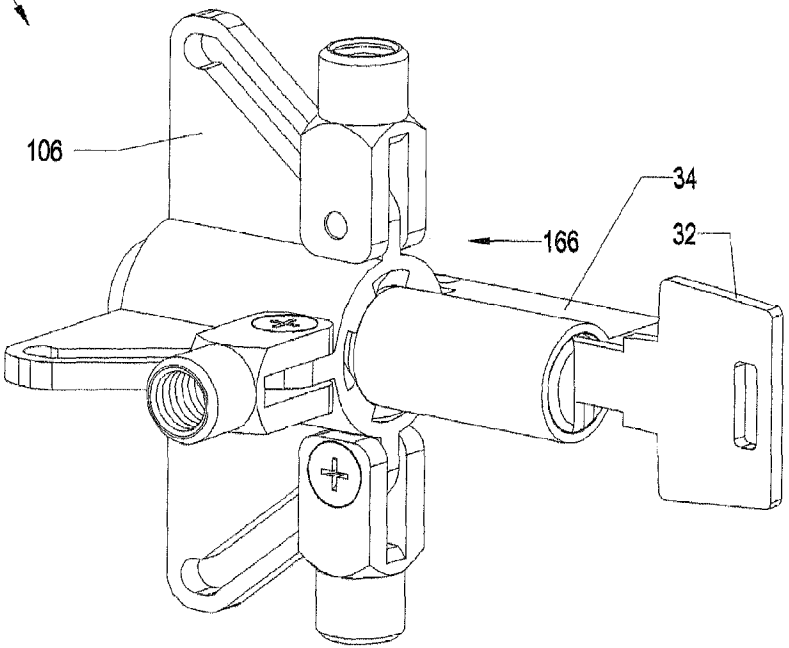
FIGS. 20-21 show perspective views of the internal portion of the high security multi-bolt lock of FIG. 19, with the winged-sleeve shown, respectively, in locked and unlocked positions.

Referring now to FIG. 21, with the bolt holders 118 positioned at the bottom of the diagonal slots 108, the bolts 124 (not shown) would be fully retracted from, for example, the cavities in the jamb of a door thereby leaving the door unlocked.

In operation, when the key 32 is rotated, for example in the clockwise direction, the winged-sleeve 104 is moved in the axial direction (arrow 166) away from the key 32 and the bolt holders 118 slide down the diagonal slots 108. It is important to note that the bolt holders 118 do not move in the axial direction as their movement is restricted to the radial direction by a respective one of the cavities 140, 142, and 144 formed in the housing 134, 132 (FIG. 19). The bolt holders 118 change position from fully extended in FIG. 20, to fully retracted, that is to say at the lower end of the slots 108, shown in FIG. 21.

When the key 32 is then rotated in the opposite direction, for example in the counter-clockwise direction, the winged-sleeve 104 is moved in the axial direction towards the key 32 causing the bolt holders 118 to move up the diagonal slots 108 until they reach the non-sloped portion 110. As stated, the bolt holders 118 do not move in the axial direction, as their movement is restricted to the radial direction by the cavities 140, 142 and 144 formed in housing 134, 132 (FIG. 19).

Figure 22:
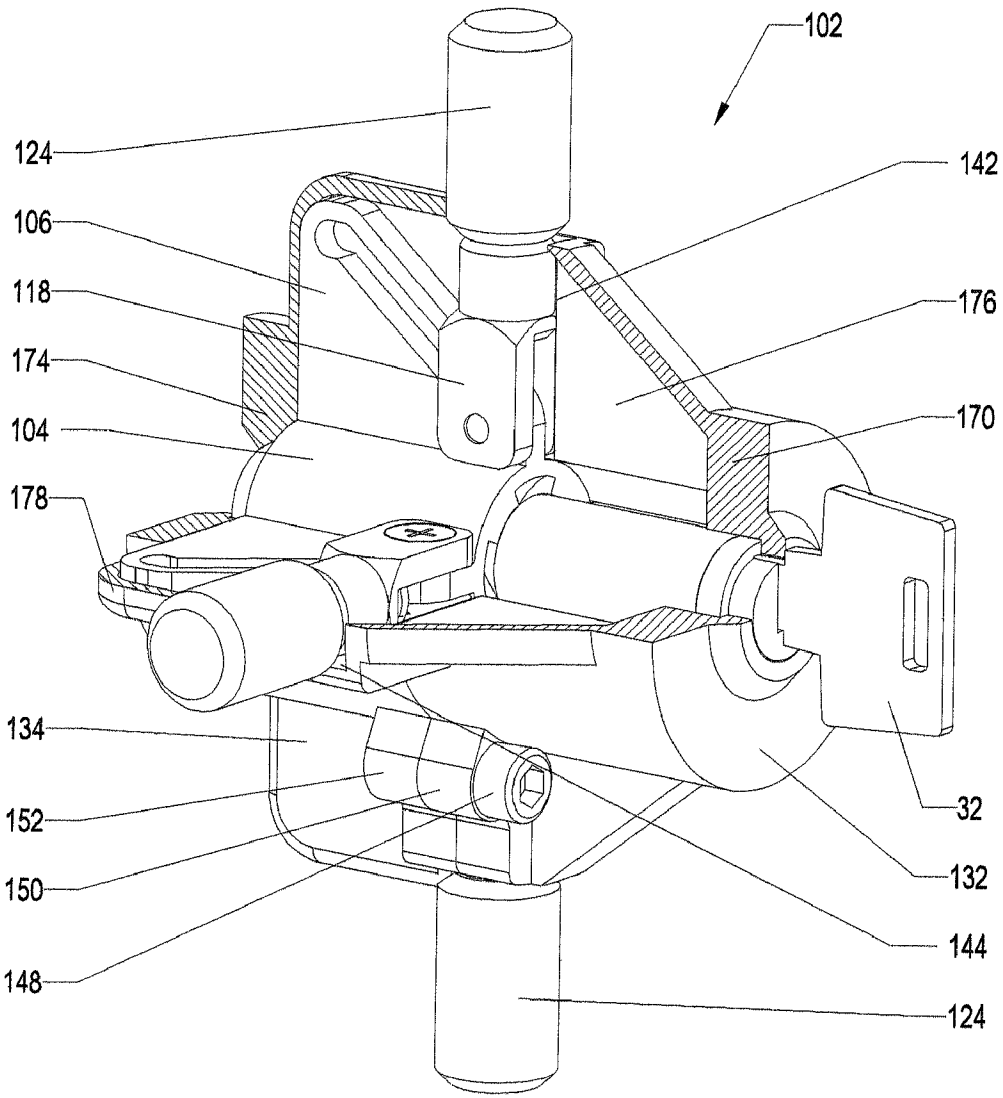
FIGS. 22-23 are partial cutaway perspective views of an assembled sleeve-type HC cylinder lock mounted in a high-security multi-bolt locking application, respectively, without and with an escutcheon plate.
Figure 23:
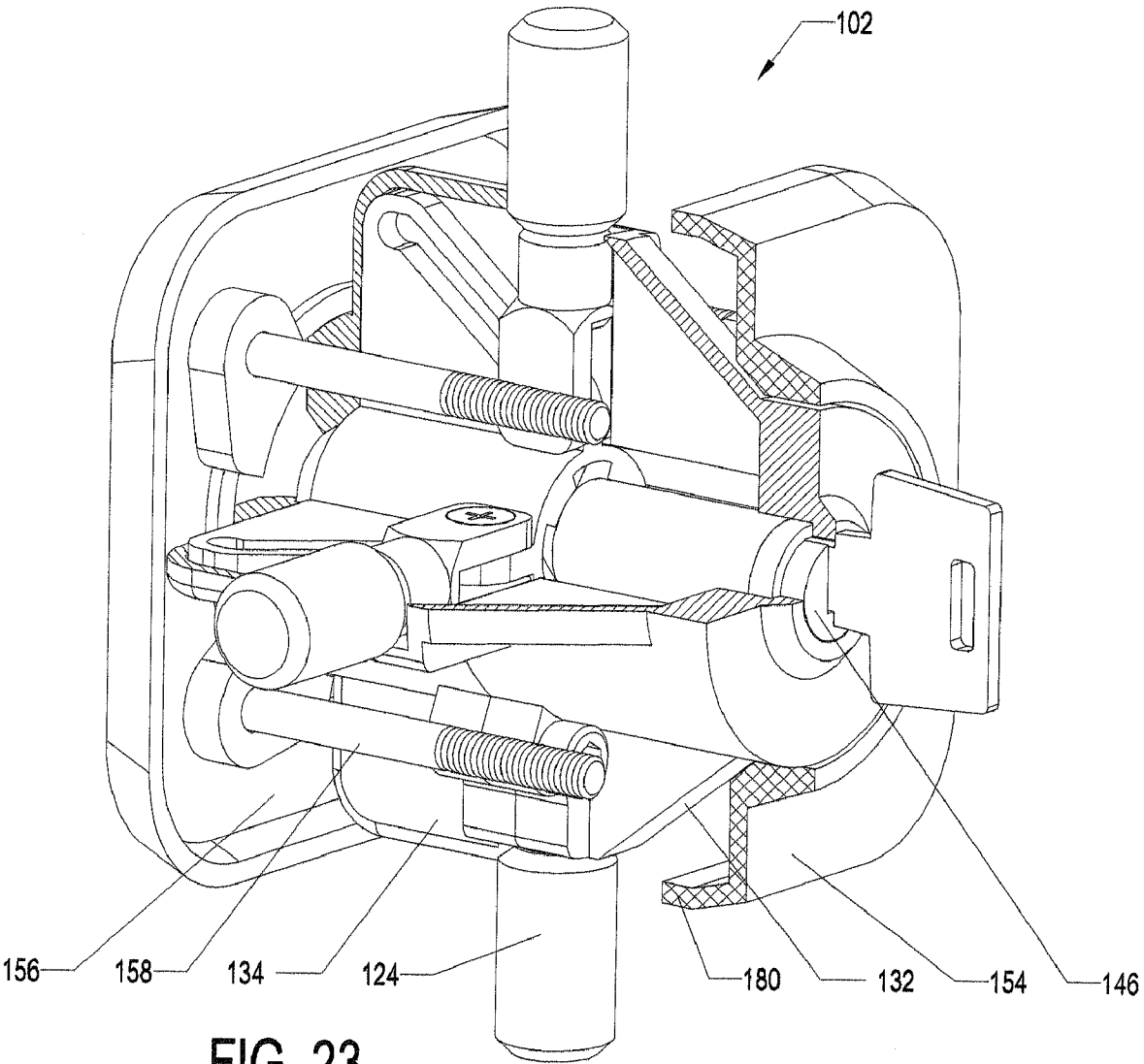

Now referring to FIGS. 22-23, there are shown partial cutaway views of the assembled multi-bolt lock, equipped with winged-sleeve HC cylinder lock 102.

In FIG. 22, one of the screws 148 can be seen joining flanges 150, 152 on the external and internal housings 132, 134. The external housing 132 and internal housing 134 of the device are shown. A cross-sectioned surface 170 of the external housing 132 is shown to facilitate viewing of the internal components. A cross-sectioned surface 174 of the internal housing 134 is shown to facilitate viewing of the internal components. The housings 132, 134 allow movement of the winged-sleeve 104 in the axial direction via cavities 140, 142 and 144 displayed in FIG. 19. The housing, however, allows the bolt holders 118 to move in the radial direction only.

This restriction of movement of the bolt holders 118 is developed by the cavities 140, 142 and 144 formed in the external housing 134, 132. Note that the winged housing section 176 will allow movement of the winged-sleeve 104 in the axial direction, however, only until the winged-sleeve 104 reaches either end of the internal volume defined by internal and external housings 134, 132.

Now referring to FIG. 23, there is shown mounted in the external housing 132 a rotatable protection disc 146 that is designed to prevent drilling of the keyway. The escutcheon plates 154, 156 are shown mounted, respectively, on the external and internal housings 132, 134, by use of long threaded screws 158 connecting between them. Note that long threaded screws 158 are only inserted from the internal escutcheon plate 156 so as to prevent unwanted tampering, which might occur if they were mounted on the exterior of the object to be secured. A cross-sectioned edge 180 of external escutcheon plate 154 is shown, to reveal the arrangement of the internal components.

Figure 24:
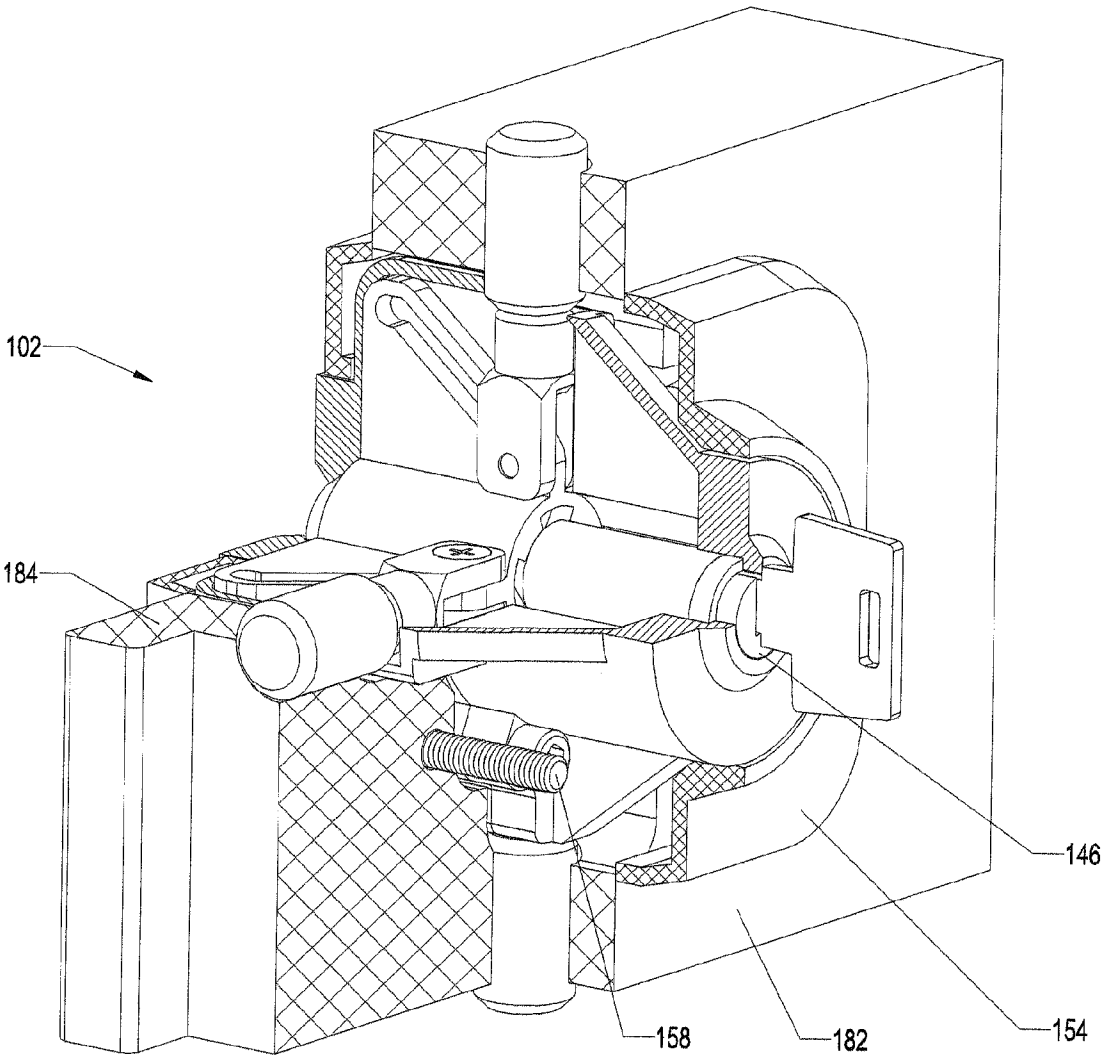
FIG. 24 is a partial cutaway view of an assembled sleeve-type HC cylinder lock mounted in a high-security multi-bolt locking application, assembled on a solid wood door.

FIG. 24 shows the high security multi-bolt lock, equipped with winged-sleeve HC cylinder lock 102 as it appears installed within a door. A cross-sectioned surface 184 of the door is shown to reveal the position of the device inside it. The view of the exterior surface 182 of the door shows that the cylinder lock 102 protrudes from it and is well protected by the external escutcheon plate 154, in addition to the protection afforded by external housing 132 and rotatable protection disc 146.

Figure 25A:
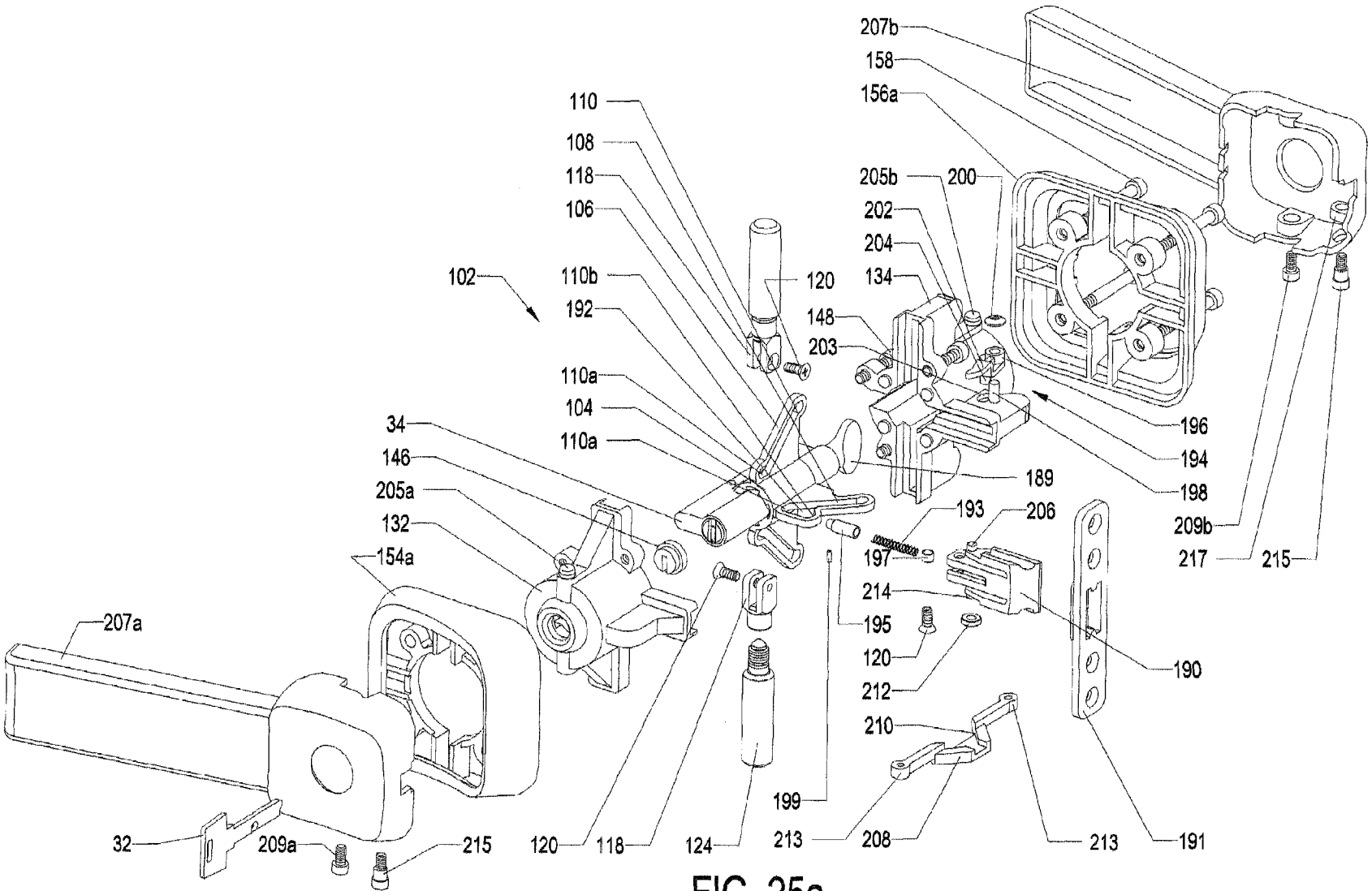
FIGS. 25*a-c* are perspective exploded views in increasing levels of detail, showing the construction of a high security multi-bolt lock equipped with the sleeve-type HC cylinder lock featuring a spring latch, which can be used as a door main lock.
Figure 25B:
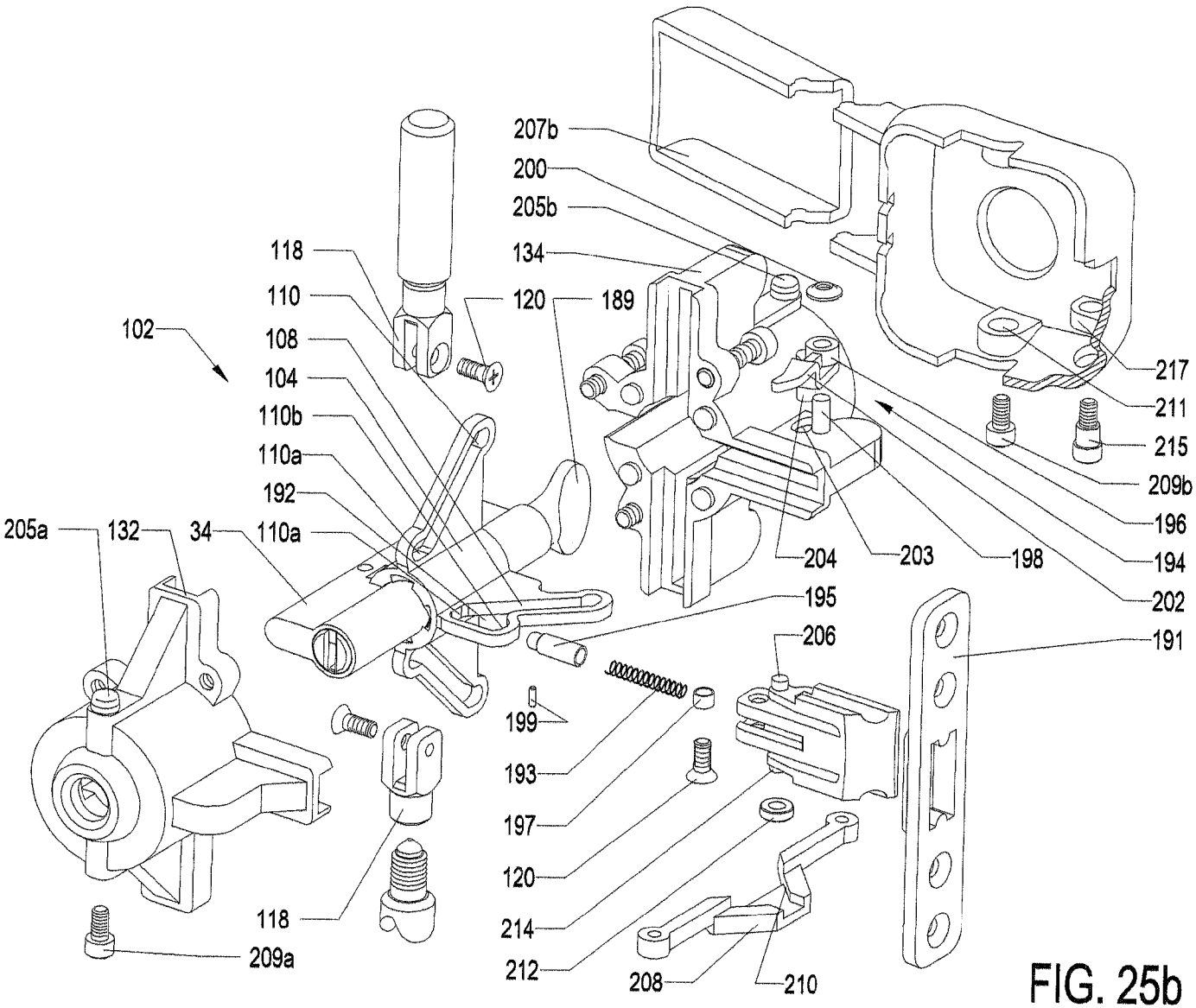
Figure 25C:
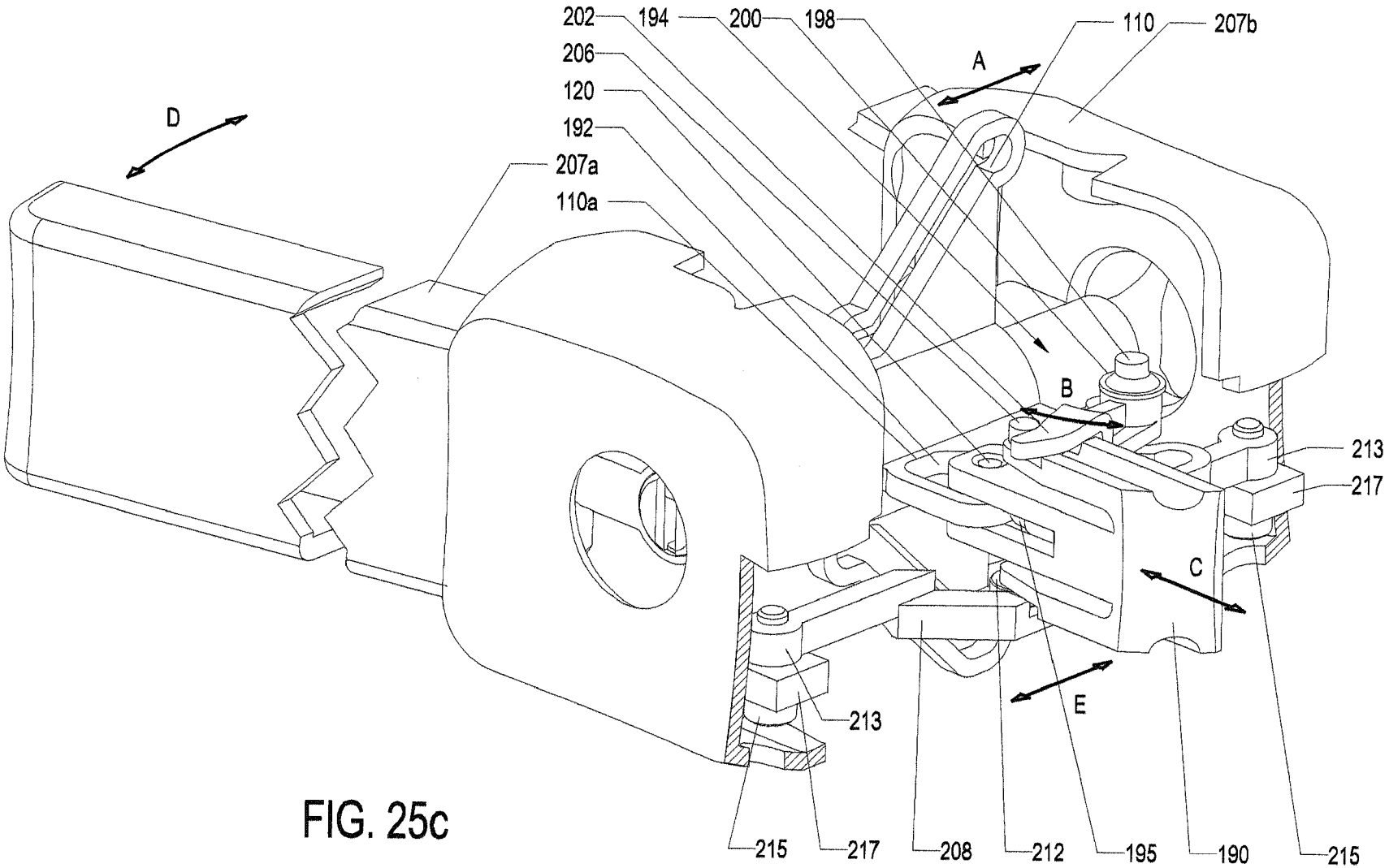

In FIGS. 25*a-c*, there are shown increasing levels of detail of an alternative embodiment of multi-bolt, sleeve-type HC cylinder lock 102, equipped with a spring latch 190. The spring latch 190 is provided as an integral feature of the main lock of a door, which enables the door to be unlocked but latched closed. The spring latch 190 mechanism is now described, and it is operated by door handles 207*a-b* which are seated respectively, in modified internal and external escutcheon plates 156*a* and 154*a*.

Typically, the spring latch 190 has three different positions: the normally latched position, when it protrudes beyond the front plate 191 from the door edge approximately 13 mm, but allows the door to be closed by slamming it shut; the deadlocked position, wherein the spring latch 190 protrudes an additional amount, for a total of about 26 mm, and operates as a deadbolt; the fully unlatched position, wherein the spring latch 190 is totally retracted within the door.

In order to achieve operation of the spring latch 190, either the door handles 207*a-b*, the key 32 or a knob 189 may be utilized, as described further herein. The spring latch operation is enabled by modification of the diagonal slots 108 of winged-sleeve 104. As shown, two of the diagonal slots 108 on two of the wings 106 are modified by addition of proximate non-sloped portions 110*a*, into each of which the slot follower screw 120 of bolt holder 118 slides when the cylinder lock 102 is in the open position. The proximate end non-sloped portions 110*a* enable a spring latch operation, now described.

In this embodiment, spring latch 190 is arranged to be spring-loaded (spring 193 is seated inside the latch 190) so as to maintain the latch normally in the latched position, maintaining the door latched.

The diagonal slot associated with the spring latch 190 is formed on the remaining wing 106 and is provided with a latching bay 192, in which the slot follower screw 120 follows the slot inside contour. The latching bay 192 is designed to have two non-sloped portions, 110*a-b*. When the winged-sleeve 104 is in the unlocked position as shown, the spring latch 190 is urged by a spring 193 and plunger 195 toward the latching bay 192, while a roller 197 follows the curvature of the latching bay 192. The spring 193 and plunger 195 are movably secured in the spring latch 190 by a retaining pin 199.

A rocker assembly 194 comprising a rocker 196 is seated on a pin 198 which is integrally formed with internal housing 134. The rocker 196 is secured in place by a retainer ring 200, and is formed with a lever portion 202 and a lower pin 204.

As shown in FIG. 25*b*, door handle 207*b* is rotatably mounted on hinge 211 for push-pull operation on pin 205*b* of internal housing 134, and door handle 207*b* is secured in place by hinge screw 209*b*.

Figures 26A, 26B, 27:
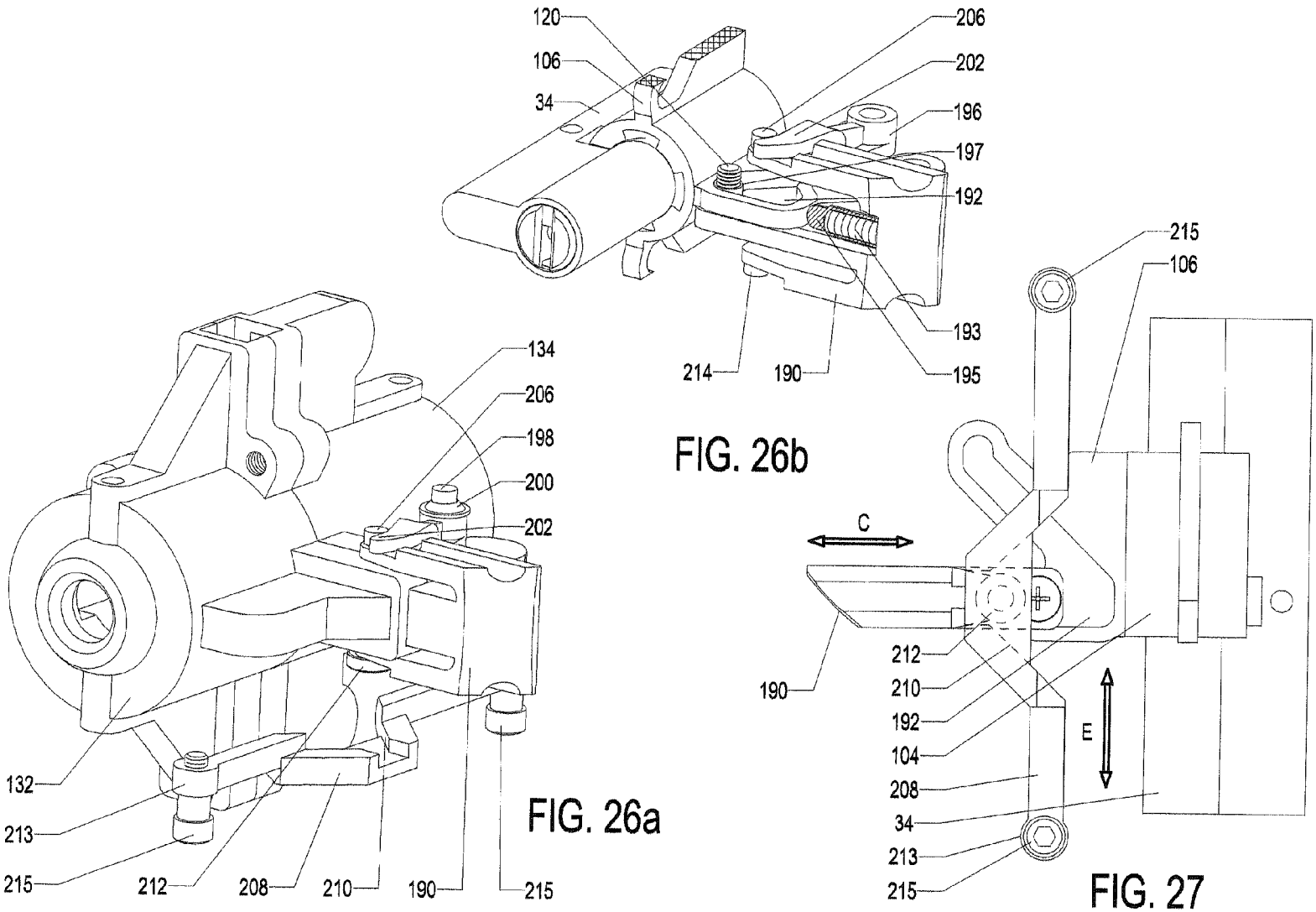
FIGS. 26*a-b* are perspective views of a rocker assembly designed to move the spring latch of FIGS. 25*a-c* by rotation of the key.
FIG. 27 is a bottom view of a push-pull actuator designed to operate the spring latch of FIGS. 25-26 by operation of a handle.

As shown in the detailed views of FIGS. 26*a-b*, spring latch 190 is shown, respectively, in the latched and unlatched positions. In the latched position, which can be better seen in FIG. 25*c*, the follower screw 120 and roller 197 are positioned in the end non-sloped portion 110*b* of locking bay 192 (see also FIGS. 25*a-b*).

The lever portion 202 is in contact with upper spring latch pin 206. The lower pin 204 of rocker 196 (see FIG. 25*b*) passes via opening 203 and is in contact with winged sleeve 104. When the key is rotated by an additional amount towards the unlocked position, winged sleeve 104 moves forward slightly in the direction of arrow A, and lower pin 204 is pushed, so that rocker 196 shifts its position (arrow B) and causes lever portion 202 to move the upper spring latch pin 206, pushing the spring latch 190 into its fully open position (arrow C).

Referring again to FIG. 25*c*, there is shown a push-pull actuator 208 provided to control operation of the spring latch 190 by push-pull motion of the door handles 207*a-b* in the direction of arrow D. The push-pull actuator 208 is formed with two ends 213, which are each connected by a connector screw 215 to a seat 217 formed on each of handles 207*a-b*. The push-pull actuator 208 is formed with two sloped surfaces 210 (see FIGS. 26*a* and 27), which are in contact with a roller 212 (see also FIGS. 25*b*, 26*a* and 27) which is seated on the lower spring latch pin 214 (see FIGS. 25*b-c*). When the push-pull actuator 208 is operated so as to move back and forth in the direction of arrow E by hinged motion of either of door handles 207*a-b* in the direction of arrow D, the push-pull actuator 208 moves so that one of its sloped surfaces 210 forces roller 212 to retract the spring latch 190 in the direction of arrow C.

FIG. 27 is a bottom view of push-pull actuator 208 designed to operate the spring latch 190 of FIGS. 25-26 by operation of handles 207*a-b*. In this view, the sloped surfaces 210 and the roller 212 are shown in dashed lines, for control of the operation of spring latch 190. When push-pull actuator 208 is moved by handles 207*a-b* in the direction of arrow E, roller 212 forces spring latch 190 to be retracted and extended in the direction of arrow C.

Figure 28:
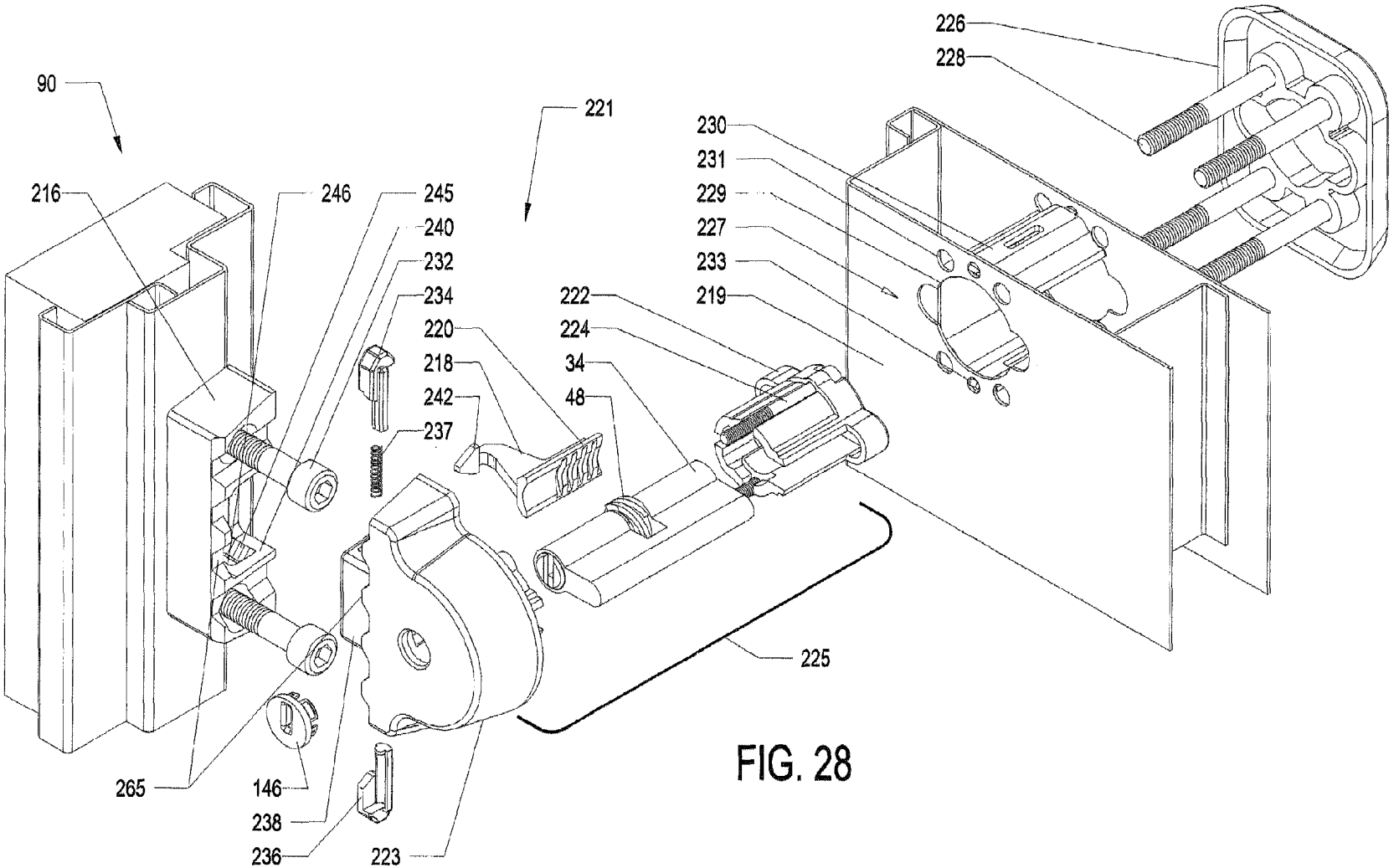
FIG. 28 is an alternative embodiment of a high security, multi-bolt lock equipped with the sleeve-type HC cylinder lock, which utilizes a single winged-sleeve and an actuator having sloped surfaces, designed to be mounted on the external surface of a door at the entrance side.

FIG. 28 is an exploded view of a modified multi-bolt, winged sleeve-type HC cylinder lock 102, operated using HC cylinder lock 34, especially designed as an auxiliary lock 221 to be mounted on the exterior face of a door 219 on the entrance side using an externally mounted locking hasp 216. This embodiment features an external housing 223 integrally formed with an external escutcheon plate. A single winged sleeve 218 has a partially circumferential sleeve portion 220, unlike the sleeve 52 of FIG. 7. In this embodiment, single winged sleeve 218 is guided in its axial motion partially by the HC cylinder lock 34 body, and also by the external housing 223, which supports one end of the HC cylinder lock 34.

The internal housing 222 of modified multi-bolt, sleeve-type HC cylinder lock 102 supports the other end of HC cylinder lock 34, and also provides guidance of the axial motion of single-winged sleeve 218. The internal housing 222 and the external housing 223 are fastened together by a plurality of bolts 224, forming a solid encasement 225 of the locking assembly containing HC cylinder lock 34, thereby protecting it from any attempted tampering. Once the encasement 225 is completed, the entire construction can be mounted through the external surface of the door 219 by drilling a set of mounting holes 227, with a main hole 229 with an approximate diameter of 40 mm for encasement 225, and a set of auxiliary mounting holes 231 for securing internal escutcheon plate 226 with mounting screws 228.

Prior to installation of the encasement 225 containing the HC cylinder lock 34 within a hollow steel door, a pair of spacers 230 are placed within the hollow door via hole 229 and their ends are snap-fit within an additional set of auxiliary mounting holes 233. Spacers 230 are provided to support the internal structure of the door 219, so that when the internal escutcheon plate 226 is tightened against external housing 223 by tightening the mounting screws 228, there is no risk of deformation of the door profile. The result of tightening the mounting screws 228 creates a strong mechanical connection between the door 219 structure and auxiliary lock 221, greatly strengthening the mounting area of auxiliary lock 221 against forced entry and tampering.

The locking hasp 216 is mounted to the external side of the door frame 90 by two strong mounting bolts 232. Locking hasp 216 is engaged by a locking mechanism 235 (see FIGS. 34*a-b*) comprising locking bolts 234 and 236, which are seated in a locking compartment 238 which forms part of external housing 223. Locking compartment 238 has both locking bolts 234, 236 seated therein in a normally open state, under spring force provided by spring 237. Locking bolts 234, 236 are arranged to protrude from locking compartment 238 so as to engage locking bays 240 in locking hasp 216.

It is a particular feature of this embodiment that the external housing 223, although shown in FIG. 28 installed on the exterior face of door 219 on the entrance side, can be installed on the door within the dwelling or storage area, etc. In addition, depending on its mounting location, the encased locking assembly can be adapted as needed for use with sliding doors, single or double swinging doors, rolling shutters, etc.

Figure 30:
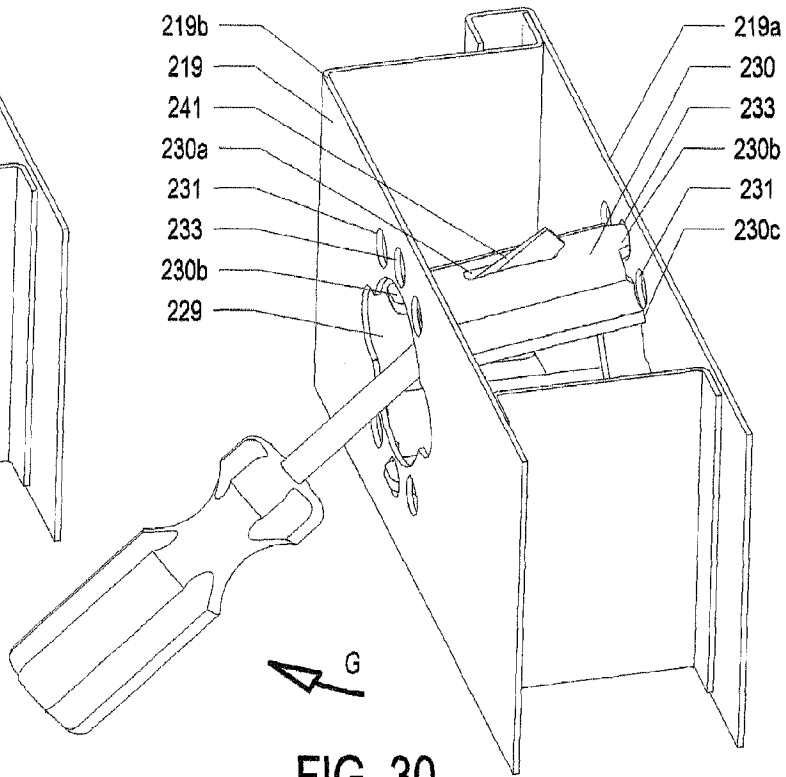
FIGS. 29-30 are perspective views of a section of a hollow steel door formed with mounting holes, showing a method for inserting a spacer used to support the door interior.
Figure 29:
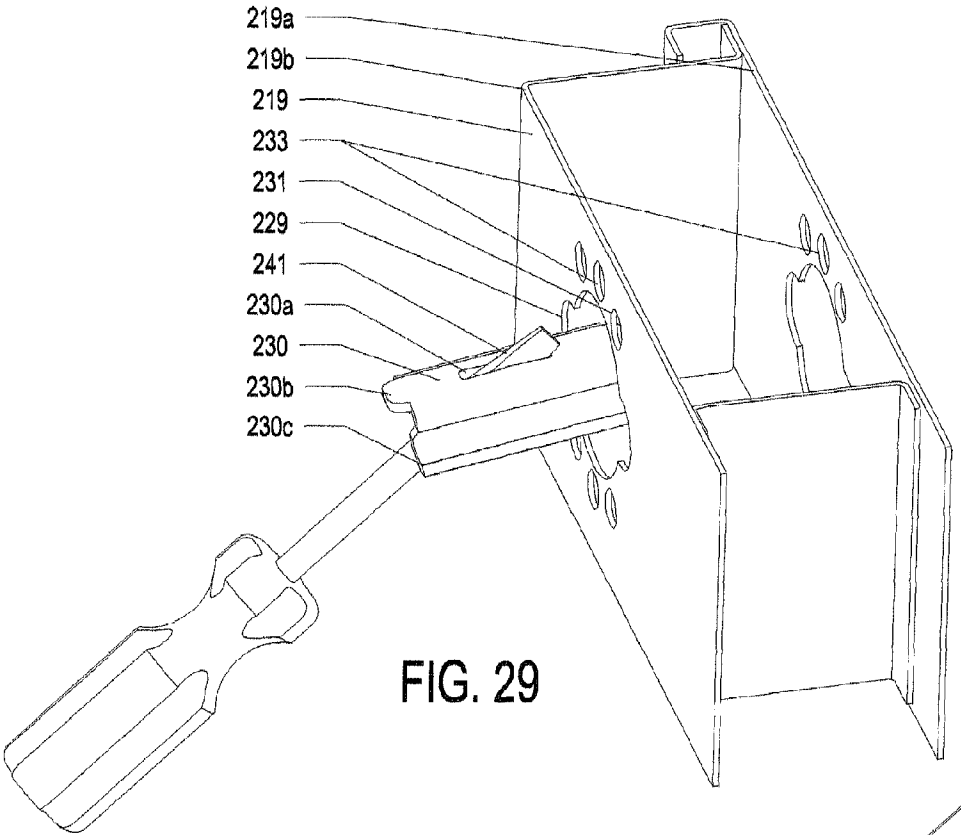

FIGS. 29-30 are perspective views of a section of a hollow steel door formed with mounting hole 229, showing a method for inserting a spacer used to support the door interior.

In order to insert the spacer 230 through the hole 229, a flat, standard screwdriver 241 is inserted into specially-designed slot 230*a* of spacer 230, which has a slot width for gripping the screwdriver end, so that the spacer 230 does not fall within the door interior once inserted via hole 229. The spacer 230 is shaped at each of both ends with a protrusion 230*b*, and shoulders 230*c*. When the spacer 230 is inserted through hole 229 using the screwdriver 241, a first protrusion 230*b* is inserted into hole 233, which serves as an anchor point. Then screwdriver 241 is rotated in the direction of arrow "G", so that the spacer 230 forces the door surfaces 219*a-b* away from each other, enabling a second protrusion 230*b* to snap into place in hole 233. The protrusions are designed to develop friction with the holes 233, so as to maintain the spacer 230 in a desired orientation. The shoulders 230*c* are then aligned with the set of auxiliary mounting holes 231. Tightening of mounting screws 228 creates a strong mechanical connection between the door 219 structure and auxiliary lock 221.

Figure 31:
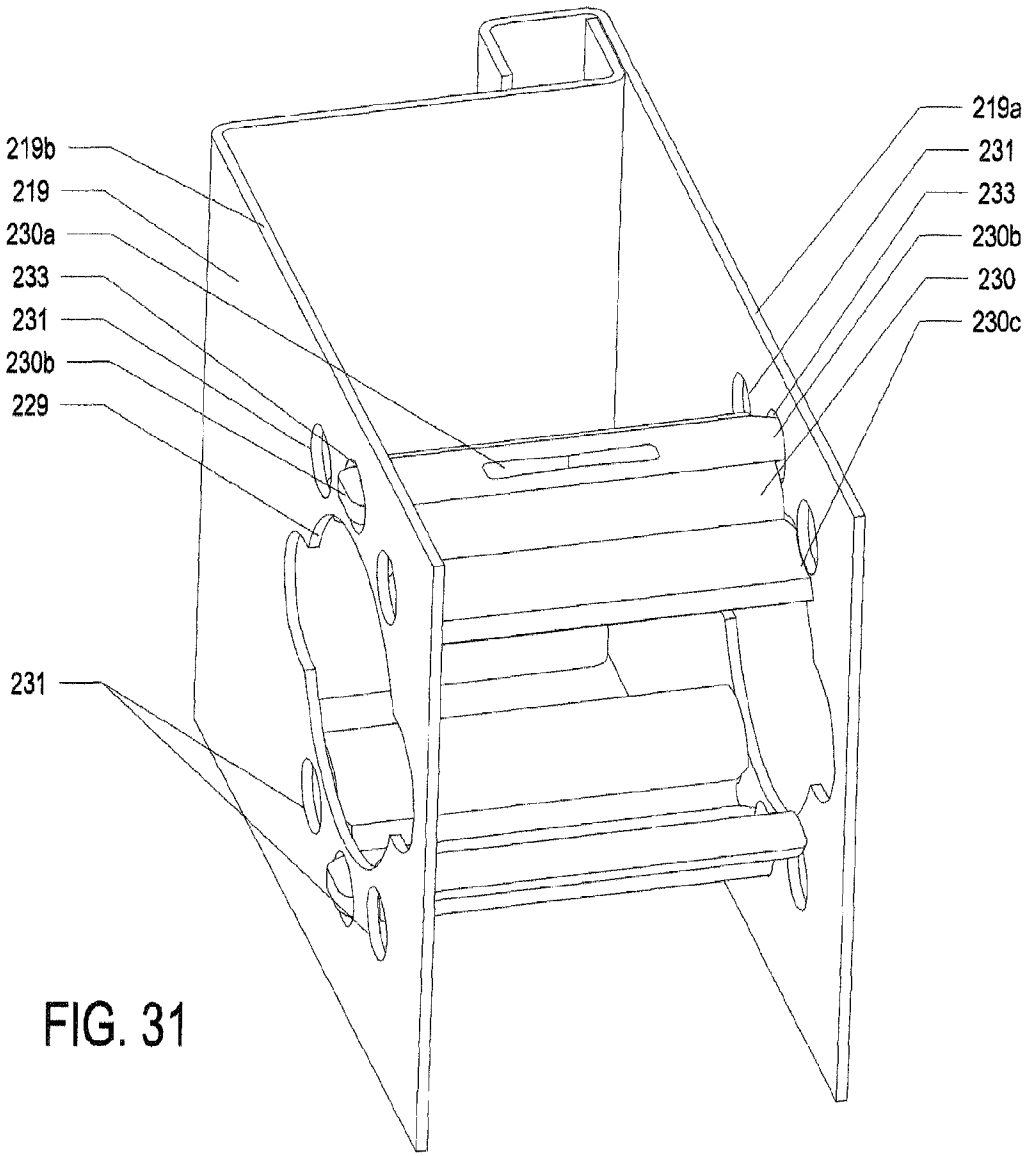
FIG. 31 is a perspective view of the door section of FIGS. 29-30, after mounting the spacers.

FIG. 31 is a perspective view of the door section of FIGS. 29-30, after mounting the spacers.

Figure 32:
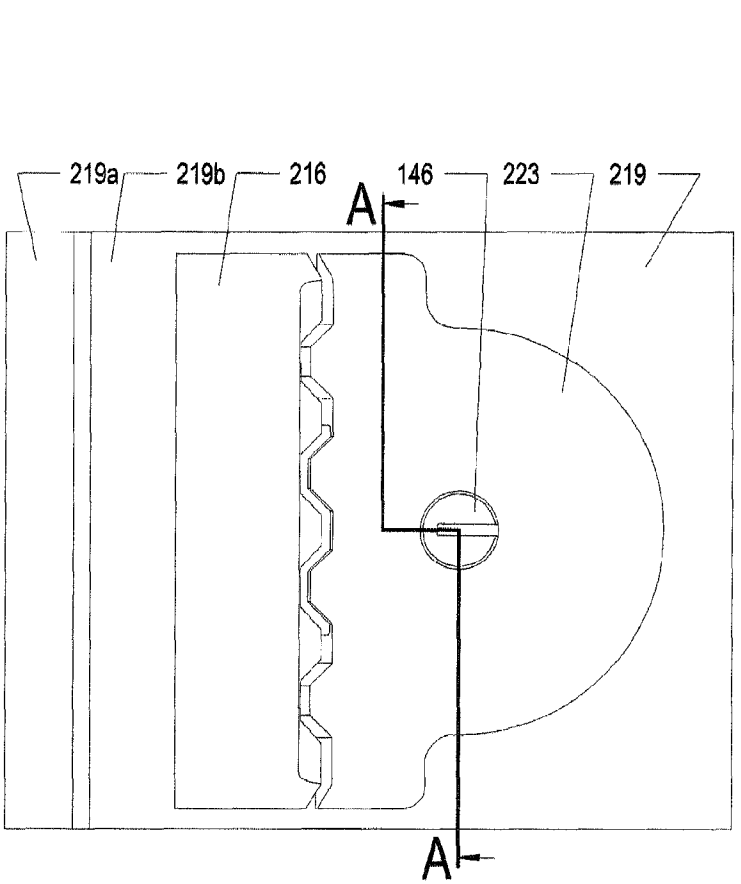
FIG. 32 is a front view of the door section having an auxiliary lock mounted on the external door section surface shown in FIG. 31.

FIG. 32 is a front view of the door section having the auxiliary lock 221 of FIG. 28 mounted on the external door section surface shown in FIG. 31.

Figure 33:
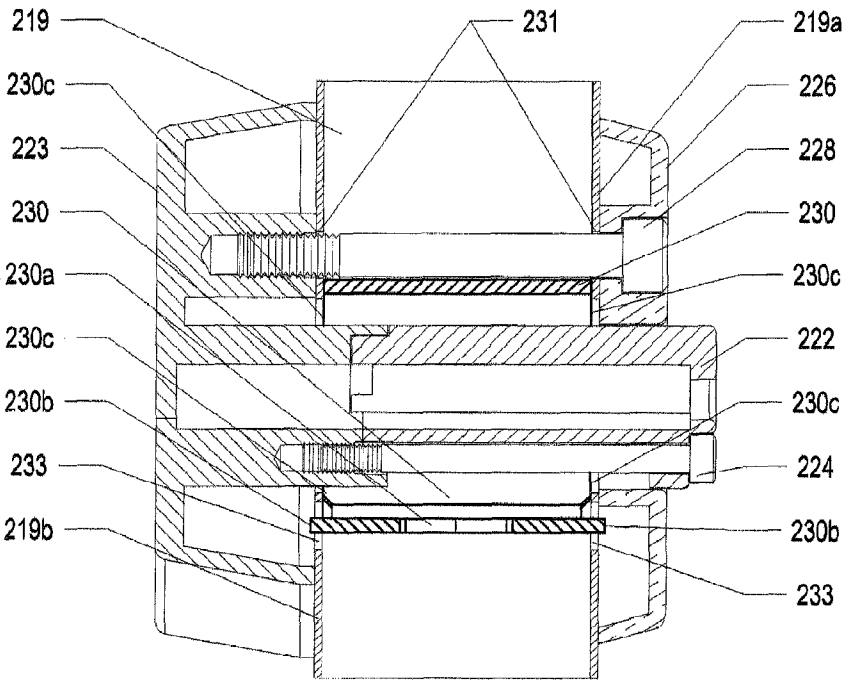
FIG. 33 is a cross-sectional view of the door section shown in FIG. 32, taken along section lines A-A, showing the spacers used to support the door interior, with the sleeve-type HC cylinder lock mounted in position.

FIG. 33 is a cross-sectional view of the door section shown in FIG. 32, taken along section lines A-A, showing the spacers 230 used to support the door interior, with the auxiliary lock 221 mounted in position.

The operation of the auxiliary lock 221 embodiment of FIG. 28 is now described. As shown in FIG. 34*a*, the wing portion of single winged sleeve 218 has formed at its distal end an actuator 242 having sloped surfaces. In a locking operation of HC cylinder lock 34, actuator 242 engages sloped edges 247 of locking bolts 234, 236 as a result of axial motion of single-winged sleeve 218. Thus, locking bolts are forced to slide apart and protrude from locking compartment 238, so as to provide locking engagement with locking hasp 216.

Figure 34B:
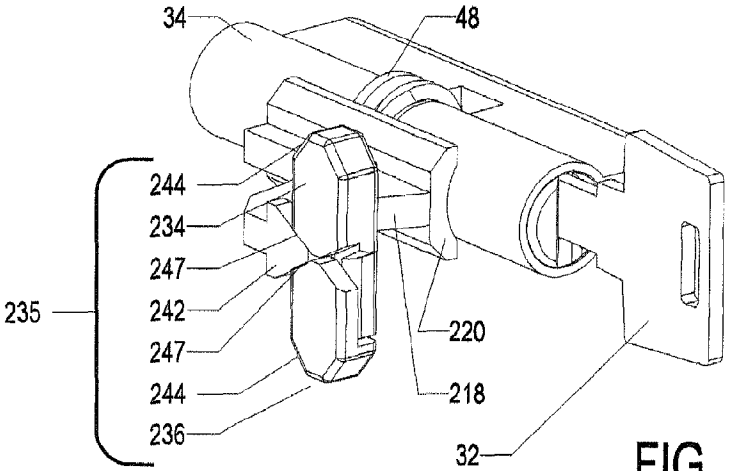
FIGS. 34*a-b* show the operation of the actuator on the locking bolts of the high-security, multi-bolt lock equipped with the sleeve-type HC cylinder lock of FIG. 28.
Figure 34A:
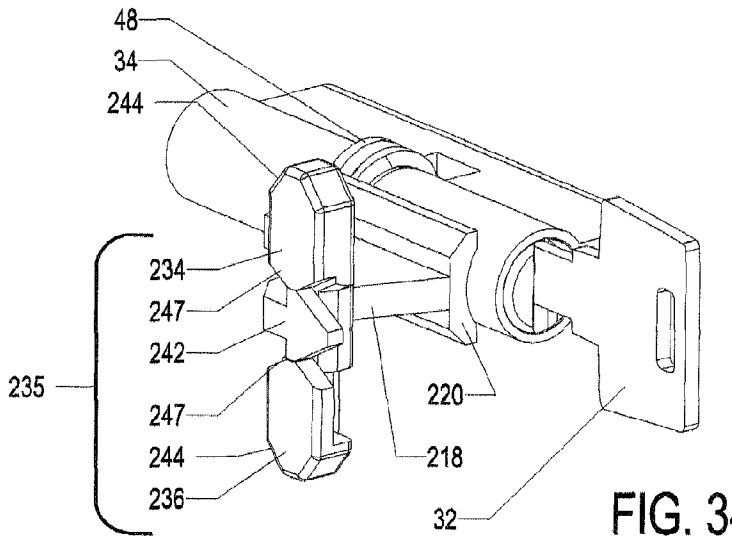

As shown in FIG. 34*b*, reversal of the axial motion of the single-winged sleeve 218 by an unlocking motion of HC cylinder lock 34, results in retraction of actuator 242, and return of the locking bolts 234, 236 into the unlocked position when they slide together, by spring pressure (spring 237—see FIG. 28).

Figure 35:
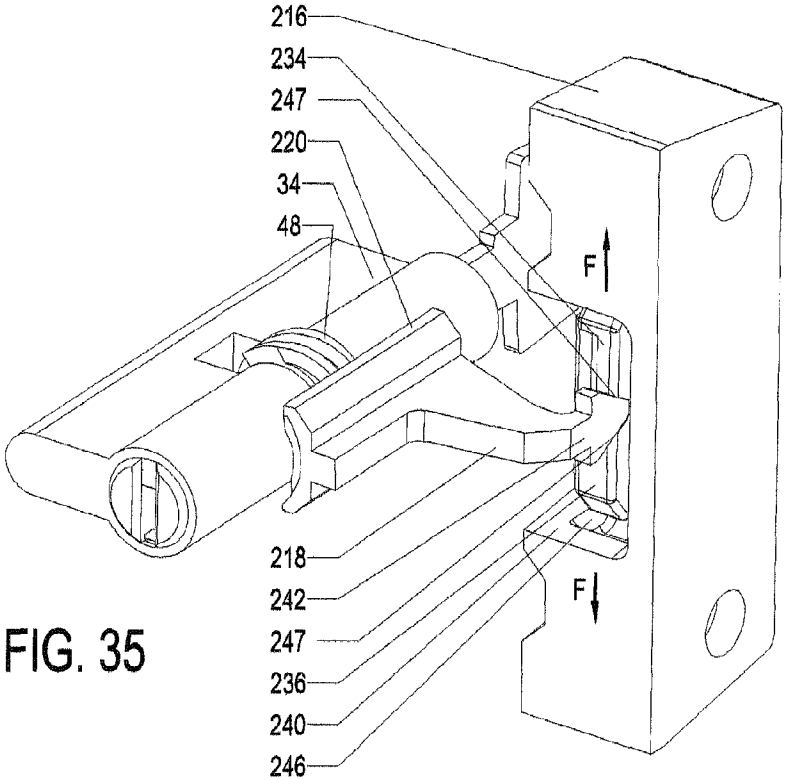
FIG. 35 shows an alternative orientation of the high-security, multi-bolt lock equipped with the sleeve-type HC cylinder lock, featuring the operation of the actuator and locking bolts within a locking hasp.

In FIG. 35, a different orientation of the arrangement of locking hasp 216 is shown, featuring the locking mechanism 235 comprising locking bolts 234 and 236. The operation of single winged sleeve 218 and actuator 242 is clearly visible against the sloped surfaces 247 of locking bolts 234, 236. When the locking bolts 234, 236 are forced apart by actuator 242 in the direction of arrows F-F, each of them is urged into a locking cavity 246 formed at the opposite ends of locking bay 240. Each of the locking cavities 246 is formed with a sloped surface 245 (see FIG. 28). A feature of the design is the provision of sloped edges 244 on external ends of locking bolts 234, 236 to assist spring 237 in developing sliding motion of the locking bolts 234, 236 together under an opening force applied by the user to open the door 219. The opening force will be transferred via the slopes 245 of locking cavity 246 to force locking bolts 234, 236 together, releasing them from locking cavity 246.

Figure 36B:
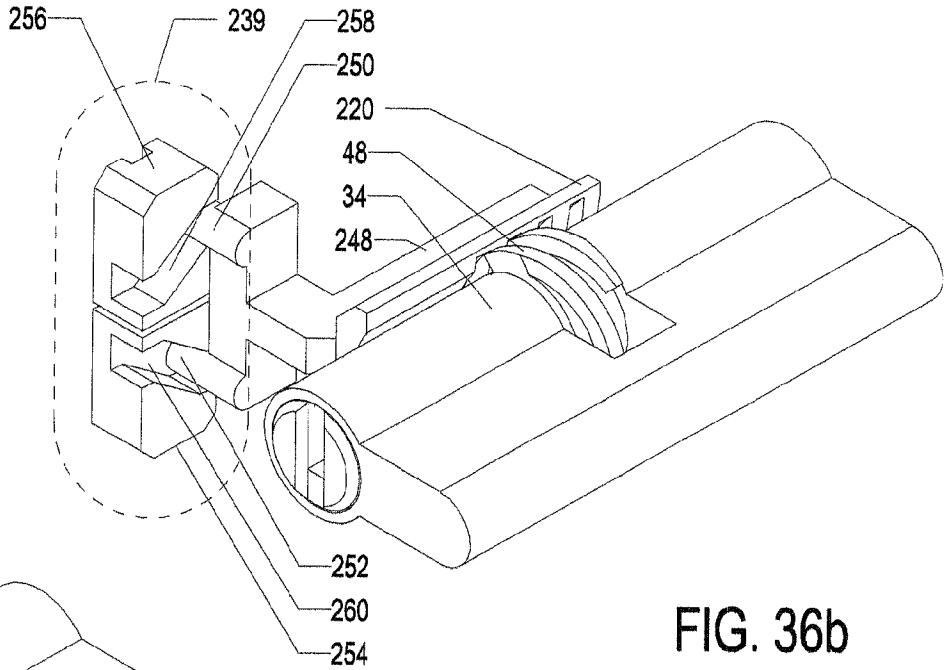
FIGS. 36*a-b* show an alternative embodiment of high-security, multi-bolt lock equipped with the sleeve-type HC cylinder lock, featuring an alternative actuator and locking bolt arrangement.
Figure 36A:
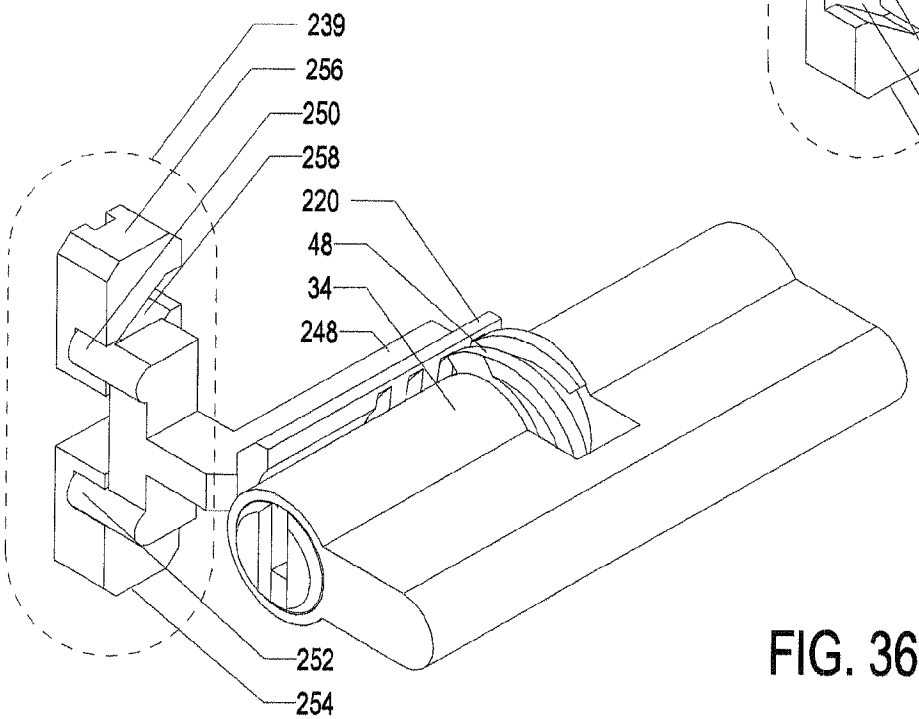

In FIGS. 36*a-b*, there is shown an alternative embodiment of locking mechanism 235, featuring a locking mechanism 239, having a winged portion 248 formed with a pair of protrusions 250, 252. In this embodiment, the locking bolts 254, 256 are formed with diagonal slots 258, 260, which engage respective protrusions 250, 252. In response to axial motion of single-winged sleeve 248 during locking and unlocking operations, protrusions 250, 252 drive motion of the respective locking bolts 256, 254 away or toward one another corresponding to locked and unlocked positions.

Figure 37:
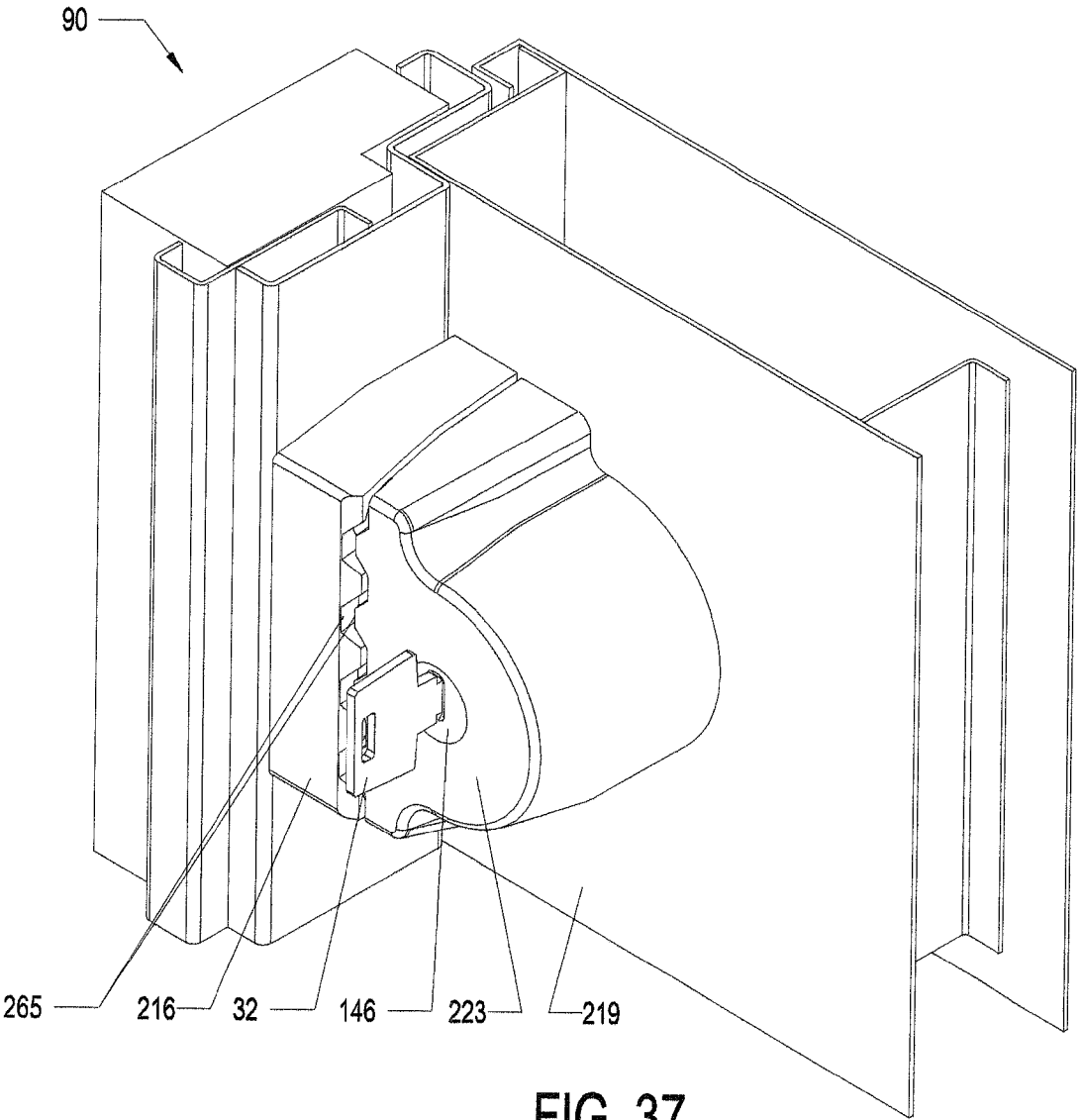
FIG. 37 is a perspective view of a door as viewed from the entrance side, equipped with a high-security, multi-bolt lock equipped with the sleeve-type HC cylinder lock, specially designed to replace a padlock.
Figure 38:
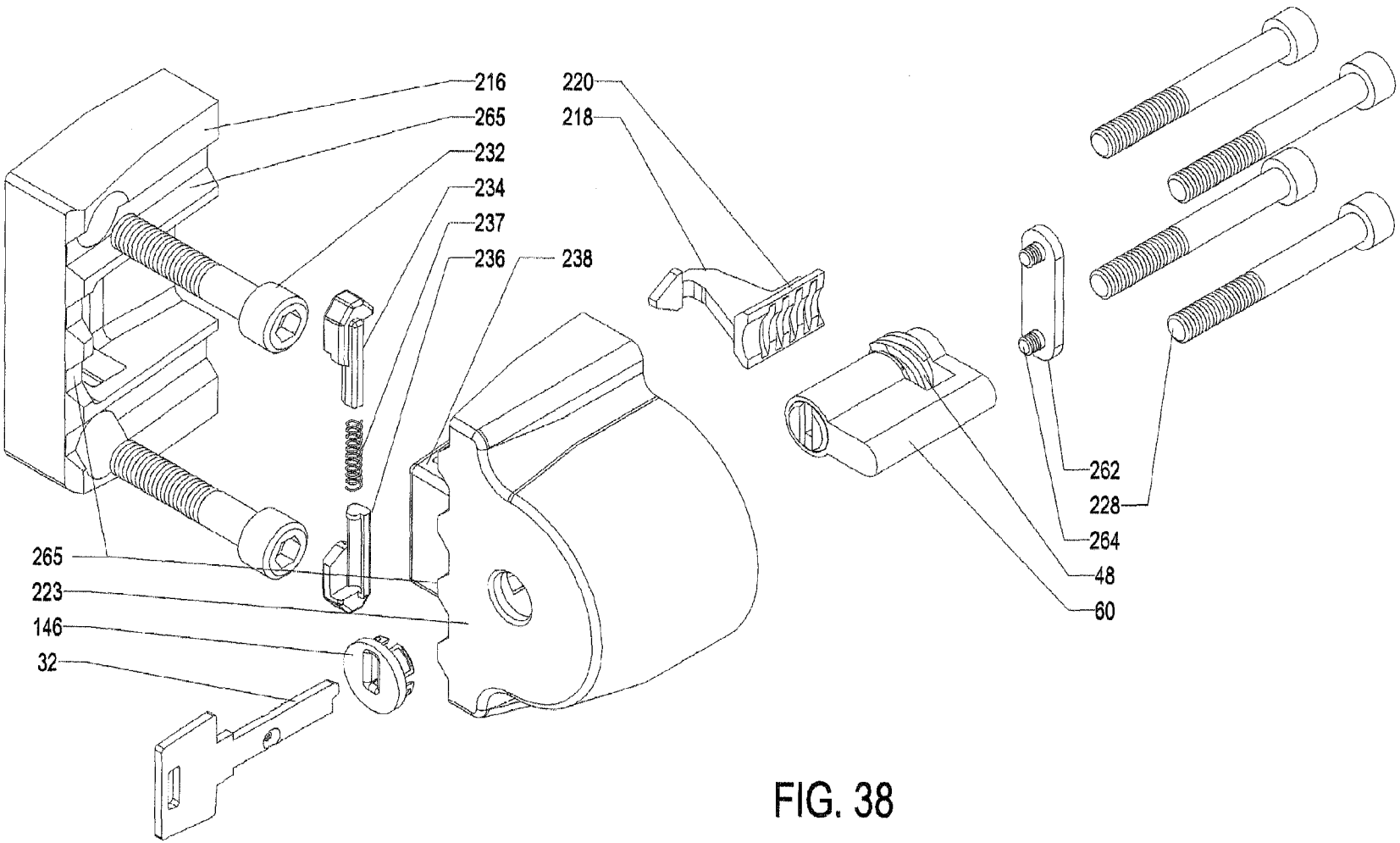
FIG. 38 is an exploded perspective view of the padlock replacement design of FIG. 37.

In FIG. 37, there is shown an additional variation of the multi-bolt, sleeve-type HC cylinder lock 102, provided as a padlock replacement fixedly mounted external to the door 219, by screws 228 (see FIG. 38). This embodiment features external housing 223 and locking hasp 216 and does not utilize an internal housing and an internal escutcheon plate as in FIG. 28. The padlock replacement can be operated with a key only from the outside of the door, exactly as is done with a padlock.

As shown, locking hasp 216 has patterned edges 265 which match those of the external housing 223. When the door is in the closed position, these edges are capable of preventing an attempted intrusion or attack using a crowbar or other tool.

In FIG. 38, an exploded view of the construction of the padlock replacement of FIG. 37 is shown, comprising external housing 223 and locking hasp 216. The external housing 223 is designed to encase the HC cylinder lock 60, in accordance with the present invention. This embodiment is also equipped with a partially circumferential single-winged sleeve 218, and the single HC cylinder lock 60 mechanism is retained in place by a retainer 262 attached to the external housing by screws 264. The locking mechanism 235 is constructed in locking compartment 238 in similar fashion to the construction shown in FIGS. 28 and 34*a-b*.

The padlock replacement of FIGS. 37-38 is arranged for screw mounting, as shown. However, the locking hasp 216 can be welded to the door frame/gate 90.

Figure 39:
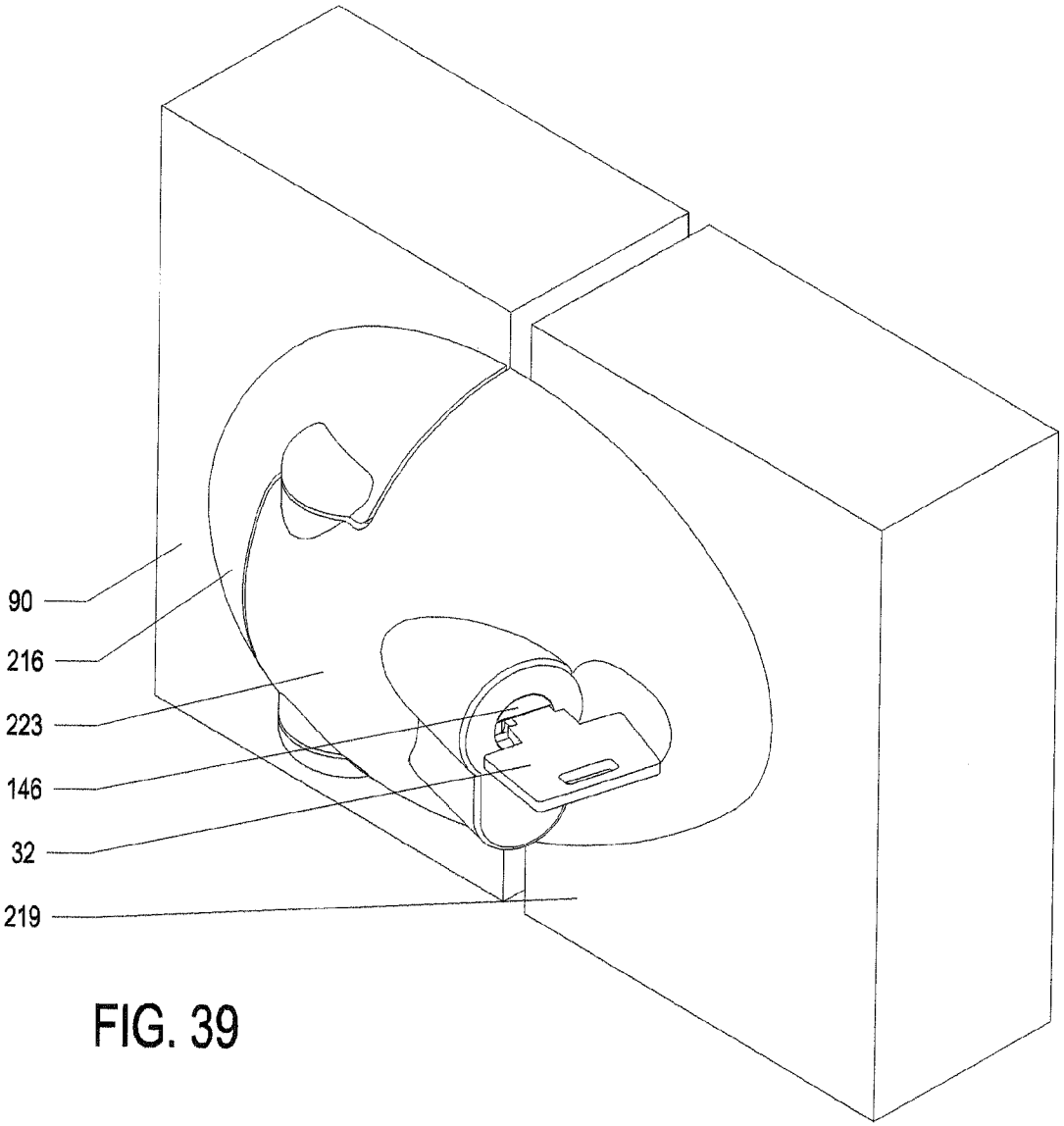
FIG. 39 is a perspective view of an alternative padlock replacement utilizing the sleeve-type HC cylinder lock of FIGS. 36*a-b*, arranged within a housing so as to be easily replaceable therein, with the housing mounted or welded to the door.

FIG. 39 is a perspective view of an alternative padlock replacement utilizing the single sleeve-type HC cylinder lock 60 of FIG. 38, arranged within an external housing 223 and utilizing locking mechanism 239 (see FIGS. 36*a-b*).

In addition to conventional screw mounting, this embodiment is designed to enable welding of the external housing 223 to the door 219 and welding of locking hasp 216 to the door frame 90. In this design, the HC cylinder lock 60 can be replaced without removing the external housing 223 from the door 219, as can be seen in FIG. 41.

Figure 40:
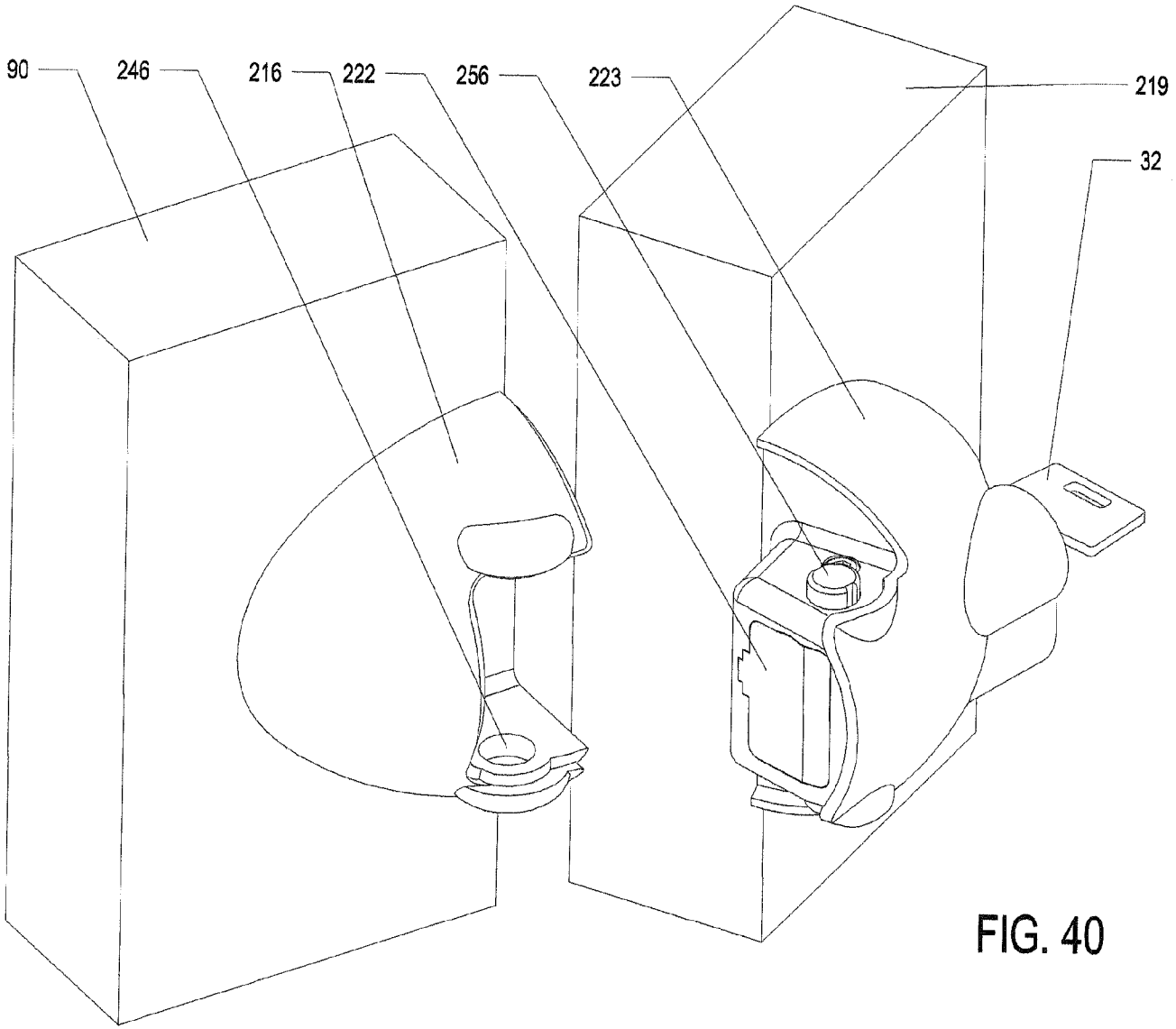
FIG. 40 is a perspective view of the padlock replacement of FIG. 39 shown when the door is open.

FIG. 40 is a perspective view of the padlock replacement of FIG. 39, shown when the door is open.

Figure 41:
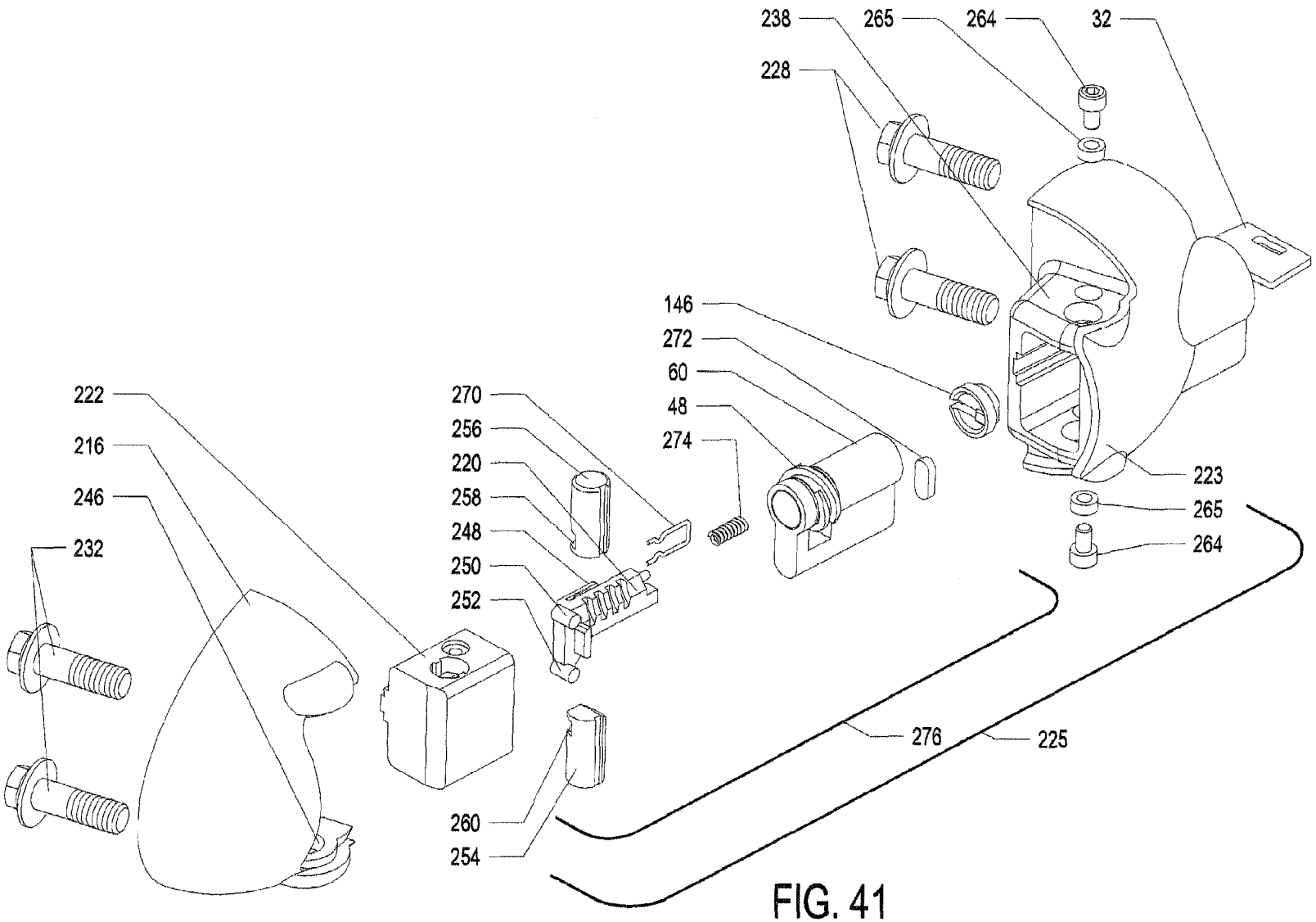
FIG. 41 is an exploded perspective view of the padlock replacement of FIG. 39.

FIG. 41 is an exploded perspective view of the padlock replacement of FIG. 39. The overall construction is similar to FIG. 38. The internal housing 222 is attached to external housing 223 by screws 264 and washers 265. The locking bolts 254, 256 pass through internal housing 222 and are engaged within the external housing 223, thereby providing additional strength to the overall construction. When the padlock is in the open position, in order to enable the internal housing 222 to be dismantled for cylinder lock replacement, it is necessary to rotate key 32 an additional quarter of a turn to compress spring 274, until protrusions 250, 252, respectively, leave slots 258, 260. Then, the locking bolts 254, 256 can be removed from the assembly. Next, the screws 264 are removed, and the internal housing 222 can be dismantled, and the whole locking mechanism 276 including HC cylinder lock 60 can be replaced.

In all of the above embodiments, the HC cylinder lock 60 features a helical cam 48 with a sleeve arranged for sliding motion, or alternatively, a pin engaging a helical slot formed in the sleeve so that it is arranged for sliding motion. This construction does not, in and of itself, provide for definition of key rotation positions, since the motion of the helical cam and sleeve is smooth and continuous. In order to provide key rotation position definitions, a horseshoe-shaped spring 270 is seated in the interface between the internal housing 222 and the external housing 223. As the helical cam 48 is rotated and the winged sleeve 218 moves, a portion of it engages spring 270, providing an audible click and sensation of position, for the user.

A feature of the invention is the provision of a very hard tungsten carbide plate 272, over the cylinder lock face, so as to prevent attempted intrusion by drilling of the cylinder lock.

The equivalent parts of FIG. 41, such as encasement 225 and internal housing 222 are modified for use in the particular embodiment shown.

Having described the invention with regard to certain specific embodiments thereof, it is to be understood that the description is not meant as a limitation, since further modifications will now suggest themselves to those skilled in the art, and it is intended to cover such modifications as fall within the scope of the appended claims.

I claim:

1. In a cylinder lock constructed as a body having at least one cylinder plug rotatably disposed therein, said at least one cylinder plug having both a key end and a non-key opposite end, the improvement comprising:

a modified cam disposed at said cylinder plug non-key opposite end, said cam having at least one thread, said cylinder lock being adapted for moving an external element arranged to engage said modified cam, said external element being arranged to slide along said cylinder lock body at least partially between said key end and said non-key opposite end upon rotation of said at least one cylinder plug.

2. The cylinder lock of claim 1, wherein said modified cam comprises a plurality of helical-shaped threads.

3. The cylinder lock of claim 2, wherein said external element has formed therein a threaded groove matching said helical thread section formed on said modified cain, thereby providing said engagement of said external element and said modified cam.

4. The cylinder lock of claim 1, wherein said modified cam comprises a protrusion extending radially from said at least one cylinder plug, said protrusion being adapted to engage a helical slot formed in said external element.

5. The cylinder lock of claim 1 in combination with a door locking mechanism utilizing multiple locking bolts.

6. The cylinder lock of claim 1 in combination with a door locking mechanism having a spring latch design, operated by at least one of the cylinder lock key and a door handle.

7. The cylinder look of claim 1 in combination with a door locking mechanism, wherein said external element itself serves as a locking bolt.

8. The cylinder lock of claim 1 in combination with a door locking mechanism, wherein said external, element comprises a winged section integrally formed therewith and projecting outwardly therefrom, said winged section having a sloped surface, said sloped surface arranged to move a locking bolt in a direction orthogonal to a cylinder body axis, in response to said axial sliding motion of said external element.

9. The cylinder lock of claim 8, wherein said sloped surface of said winged section comprises a diagonal slot formed in said winged section and extending between an end proximate said cylinder body and an end distal to said cylinder body.

10. The cylinder lock of claim 9, wherein said distal end of said diagonal slot is formed with a non-sloped portion, enabling a deadlocking bolt operation.

11. The cylinder lock of claim 9, wherein said proximate end of said diagonal slot of said external element is formed with a non-sloped portion, enabling a spring latch operation.

12. A door locking mechanism utilizing the cylinder lock of claim 1, having a spring latch design, operated by at least one of the cylinder lock key and a door handle.

13. A door locking mechanism utilizing the cylinder lock of claim 1, provided with a locking hasp and mounted on an external entrance side of a door, with said door locking mechanism being operable by the cylinder lock from either side of the door.

14. The door locking mechanism of claim 13, wherein said door locking mechanism is encased and protected from all sides to prevent attempted intrusion.

15. The door looking mechanism of claim 13, wherein said door locking mechanism is provided with a patterned edge which engages a patterned edge of said locking hasp, to prevent forced intrusion.

16. A door locking mechanism utilizing the cylinder lock of claim 1, configured as a padlock replacement provided with a locking hasp and fixedly mounted on an external entrance side of a door, with said door locking mechanism being operable by the cylinder lock only from the outside of the door, and being encased within an external, housing and protected from all sides to prevent attempted intrusion.

17. The door locking mechanism of claim 16, wherein said locking hasp is formed with a patterned edge which engages a patterned edge of said external housing, to prevent forced intrusion.

18. A door locking mechanism utilizing the cylinder lock of claim 1, further comprising a spacer element for supporting the internal structure of a hollow metal door, placed within said internal structure of said door when at an installation site thereof, said spacer element enabling proper tightening of mounting screws of said door locking mechanism seated within said door via a hole formed in said door proximate to said spacer element, without deforming the door profile, and providing a strong mechanical connection with the door structure, thus strengthening the mounting area of said door Locking mechanism.

19. The door locking mechanism of claim 18 wherein the spacer element is designed for insertion within said internal structure of the hollow metal door via said hole formed as a main mounting hole prepared for the insertion of said locking mechanism.

20. The door locking mechanism of claim 18 wherein the spacer element is formed with protrusions on each of both ends, arid shoulders, such that when the spacer is Inserted through said main mounting hole, a first protrusion is inserted in an auxiliary mounting hale, which serves as an anchor point, enabling snap-fit of a second protrusion to complete the mounting.

21. The door locking mechanism of claim 19 wherein the spacer element has been inserted within said internal structure of the hollow metal door by a method incorporating use of a standard, flat screwdriver which engages a specially-designed slot formed in said spacer element as it is placed through said hole, thereby preventing said spacer element from falling within the door interior during installation.

22. The door locking mechanism of claim 20, wherein said protrusions of the spacer element are formed so as to create friction with said door internal structure, thereby maintaining said spacer element in a desired orientation.

23. In a cylinder lock constructed as a body having at least one cylinder plug rotatably disposed therein, said at least one cylinder plug having both a key end and a non-key opposite end, wherein the improvement comprises a modified cam disposed at said cylinder plug non-key opposite end, said cam having at least one thread, a method of operating said cylinder lack comprising;

providing an external element shaped to engage said cam, and rotating said cylinder plug by an appropriate key, such that said external element slides along said cylinder lock body at least partially between said key end and said non-key opposite end upon rotation of said at least one cylinder plug.

* * * * *